US007164415B2

(12) United States Patent
Ooishi et al.

(10) Patent No.: US 7,164,415 B2
(45) Date of Patent: Jan. 16, 2007

(54) DISPLAY CONTROLLER AND DISPLAY DEVICE PROVIDED THEREWITH

(75) Inventors: Yoshihisa Ooishi, Yokohama (JP); Hiroyuki Nitta, Fujisawa (JP); Takeshi Maeda, Yokosuka (JP); Tomohide Ohira, Mobara (JP)

(73) Assignee: Hitachi, Ltd., Tokyo (JP)

( * ) Notice: Subject to any disclaimer, the term of this patent is extended or adjusted under 35 U.S.C. 154(b) by 418 days.

(21) Appl. No.: 10/197,873

(22) Filed: Jul. 19, 2002

(65) Prior Publication Data

US 2003/0122854 A1 Jul. 3, 2003

(30) Foreign Application Priority Data

Nov. 29, 2001 (JP) ..... 2001-365224

(51) Int. Cl.
*G09G 5/00* (2006.01)
*G09G 3/36* (2006.01)
*G09G 5/10* (2006.01)

(52) U.S. Cl. ..... 345/204; 345/90; 345/208; 345/690

(58) Field of Classification Search ..... 345/87–104, 345/690, 204–214, 507–509, 516
See application file for complete search history.

(56) References Cited

U.S. PATENT DOCUMENTS 5,374,941 A 12/1994 Yuki et al.
5,546,104 A 8/1996 Kuga
5,898,442 A * 4/1999 Takebe ..... 345/531
5,900,856 A * 5/1999 Iino et al. ..... 345/100
6,127,995 A * 10/2000 Furuhashi et al. ..... 345/96
6,483,497 B1 * 11/2002 Iino et al. ..... 345/100
6,825,824 B1 11/2004 Lee ..... 345/89

FOREIGN PATENT DOCUMENTS

| | | |
|---|---|---|
| JP | 08-179734 | 7/1986 |
| JP | 04-204593 A | 7/1992 |
| JP | 2000-112448 A | 4/2000 |
| JP | 2000-221475 A | 8/2000 |
| JP | 2001-154170 A | 6/2001 |
| JP | 2001-265298 A | 9/2001 |
| KR | 10-0191312 B1 | 1/1999 |
| KR | 2001-48870 A | 6/2001 |

* cited by examiner

*Primary Examiner*—Vijay Shankar
(74) *Attorney, Agent, or Firm*—Antonelli, Terry, Stout and Kraus, LLP.

(57) ABSTRACT

The present invention can realize better display of a dynamic image, and in addition, can make storage capacity of a memory smaller. A data conversion circuit 112 compares display data 102 of an n-th frame from the outside and display data 116 of the (n−1)-th frame stored in the memory 104, to generate a driving data signal 117 to deliver to a driver. Each time when a memory control circuit 103 reads display data q0, q5, q10, q15 corresponding to 20 pixels out of the display data 116 of the (n−1)-th frame, the memory control circuit 103 compresses display data d0–d19 of 20 pixels out of the display data 102 of the n-th frame from the outside to generated d0, d5, d10, d15, and stores the generated data into the same area where the display data q0, q5, q10, q15 of the display data of the (n−1)-th frame have been stored.

20 Claims, 22 Drawing Sheets

FIG.8

| LIMIT OF NEW DATA | | CONVERSION COEFFICIENT | | | |
|---|---|---|---|---|---|
| | | RISE | | FALL | |
| Limit2 | 208 | Kr2 | 0.1875 | Kf2 | 0.7500 |
| Limit1 | 128 | Kr1 | 0.3750 | Kf1 | 0.7500 |

DISPLAY CONTROLLER AND DISPLAY DEVICE PROVIDED THEREWITH

BACKGROUND OF THE INVENTION

1. Field of the Invention

The present invention relates to a display controller that outputs a driving signal to a driver circuit of a display part according to display data received from the outside, in particular, a display controller that improves dynamic image displaying performance, and to a display device provided with this display controller.

2. Related Art Statement

In an active matrix liquid crystal display device, display data inputted from an outside system are transformed into gradation voltage, and the gradation voltage is supplied as drain voltage to a liquid crystal panel, realizing gradation displaying. Recently, in the field of such an active matrix liquid crystal display device, a liquid crystal panel is advancing toward a larger screen and higher color purity.

However, a now common TFT liquid crystal material has a response speed of about 20–40 ms. This becomes a main cause of a sense of after-image when a dynamic image is displayed, and, in the present state, satisfactory displaying performance has not been obtained yet. In particular, generally, a response speed of liquid crystal is lower in the case where display changes "from a half tone to a half tone" than in the case where display changes "from white to black" or "from black to white", sometimes taking a threefold or fourfold time.

As a technique for solving this problem, is known a method for example as shown in Japanese Unexamined Patent Laid-open No. 2000-221475 in which display data for a preceding frame (field) is stored in a memory, and in a next frame, the stored display data is compared with new display data inputted from the outside. Depending on the comparison result, the display data is changed, and gradation display is realized according to the changed display data.

When the above-described technique is employed, response speeds in half tone displaying can be improved, and apparently better displaying quality than before can be obtained.

However, in the above-described technique, display data for one frame should be held always, and further, memory capacity corresponding to two frames is required, since read operation and write operation on the memory should be performed at the same time. This causes problems such as increase of the mounting area of the substrate, increase of the power consumption, increase of the price, and the like.

SUMMARY OF THE INVENTION

An object of the present invention is to provide a display controller that can obtain good display quality without giving a sense of after-image even in displaying a dynamic image while suppressing increase of the memory mounting area, the power consumption and the price, and to provide a display device provided with that display controller.

To attain the above-mentioned object, the present invention provides a display controller for outputting a driving data signal to a driver circuit of a display part according to display data from the outside, comprising:

a memory for storing said display data;

a display data conversion means that compares display data of an n-th (n is a natural number) frame from outside with display data of the (n−1)-th frame temporally stored in said memory, generates said driving data signal for displaying the n-th frame, based on a comparison result, and outputs said driving data signal to said driver circuit;

a memory control means that reads display data of N (N is a natural number greater than 1) pixels of said (n−1)-th frame from said memory to deliver the read display data to said display data conversion means, and, correspondingly to reading of said display data of N pixels of the (n−1)-th frame, writes display data of N pixels of said n-th frame into an area (of the memory) from which said display data of N pixels of the (n−1)-th frame having been read.

Further, to attain the above object, the present invention provides a display device comprising:

the display controller;

said driver circuit for receiving said driving data signal generated by said display data conversion means of said display controller; and said display part driven by said driver circuit.

According to the present invention described above, display data of an n-th frame and the (n−1)-th frame are compared, and, based on the comparison result, a driving data signal for displaying the n-th frame is generated. Accordingly, it is possible to obtain better display quality without a sense of after-image in displaying a dynamic image.

Further, according to the present invention, the display data of N pixels of the (n−1)-th frame are read sequentially from the memory, and each time when display data of N pixels of the (n−1)-th frame are read, display data of N pixels of the n-th frame are sequentially written into the memory area from which the display data of N pixels of the (n−1)-th frame have been read. Accordingly, as the storage capacity of the memory, capacity of two frames is not required, since the capacity of one frame is sufficient. In other words, the storage capacity of the memory can be reduced. Thus, it is possible to suppress increase of the mounting area of the memory, increase of power consumption, and price increase. In particular, when display data are compressed before storing into the memory, the mentioned effects become larger. Further, owing to miniaturization of the memory, the memory, the display data conversion means, and the memory control means can be formed on one circuit chip, and as a result, the display controller becomes smaller and of lower cost, furthermore, while realizing high-speed processing.

BRIEF DESCRIPTION OF THE DRAWINGS

FIG. 8 is an explanatory view showing limits and coefficients in data correction of the first embodiment of the present invention;

DETAILED DESCRIPTION

Figure 1:
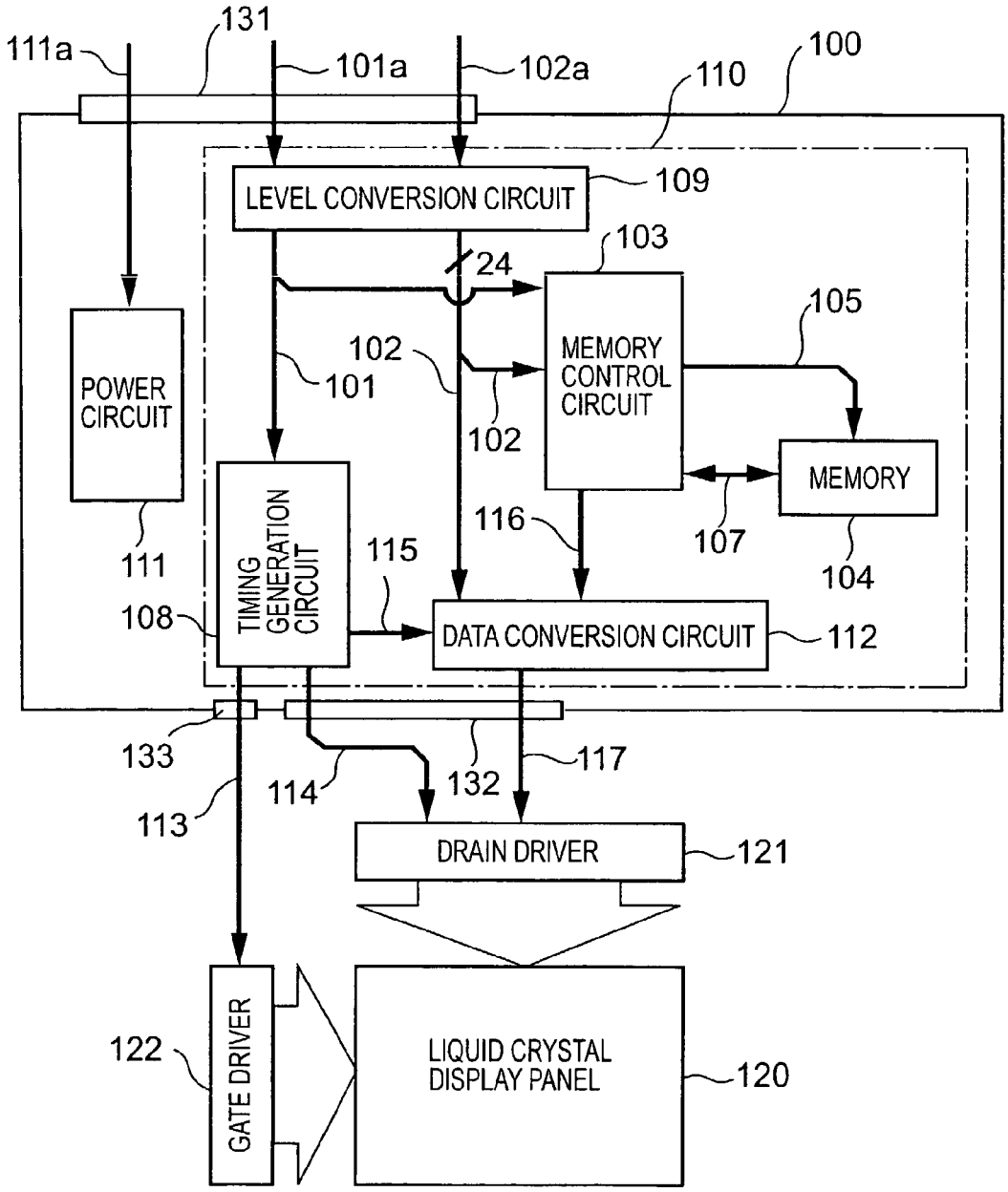
FIG. 1 is a circuit block diagram showing a liquid crystal display device of a first embodiment according to the present invention.

Now, various embodiments according to the present invention will be described referring to the drawings.

First, referring to FIGS. 1–10, 21 and 22, a liquid crystal display device of a first embodiment according to the present invention will be described.

The liquid crystal display device of the present embodiment comprises a liquid crystal display panel 120, drivers 121 and 122 for driving the liquid crystal display panel 120, and a control circuit 100 for outputting signals to the drivers 121 and 122.

Although not shown, the liquid crystal display panel 120 is provided with a plurality of drain lines, a plurality of gate lines perpendicular to those drain lines, and pixel electrodes provided correspondingly to intersections of those lines. In the present embodiment, the number of pixels of this liquid crystal display panel 120 is 1024×3×768, and 8 bits of a display signal are inputted to each pixel.

The drivers 121 and 122 consist of a drain driver 121 for applying voltage on the plurality of drain lines of the liquid crystal display panel 120 and a gate driver 122 for applying voltage on the plurality of gate lines of the liquid crystal display panel 120.

The control circuit 100 comprises a TCON (Timing Convertor) circuit 110 for converting display data 102*a* or the like from the outside into a driving data signal or the like corresponding to driving of the liquid crystal display panel 120, and a power circuit 111 for receiving power from the outside and supplying the power to various parts. The TCON circuit 110 and the power circuit 111 are formed on one control substrate. Further, the TCON circuit 110 is implemented on one chip.

The TCON circuit 110 comprises: a level conversion circuit 109 for converting display data 102*a* or the like as a differential signal from the outside into display data 102 or the like as a CMOS signal; a display data memory 104 for storing the display data 102 as a CMOS signal for one frame; a memory control circuit (a memory control means, a data compression means) 103 for controlling writing and reading of data to and from the display data memory 104; a display data conversion circuit (a display data conversion means, a data expansion means) 112 for generating a driving data signal 117 from display data 102 for an n-th frame, which is received from the level conversion circuit 109, and display data 116 for an (n−1)-th frame, which is stored in the display data memory 104; and a timing signal generation circuit 108 for generating various timing signals 113, 114, 115, based on a control signal 101 from the outside. Here, it is assumed that the display data 102*a* as a differential signal is inputted from the outside. However, in the case where the inputted signal is display data as a CMOS signal, then, of course, the level conversion circuit 109 is not necessary. Or, in the case where the display data is inputted from the outside in another form than a differential signal and a CMOS signal, then, a transmitter IC corresponding to the signal can be used as the level conversion circuit.

Figure 21:
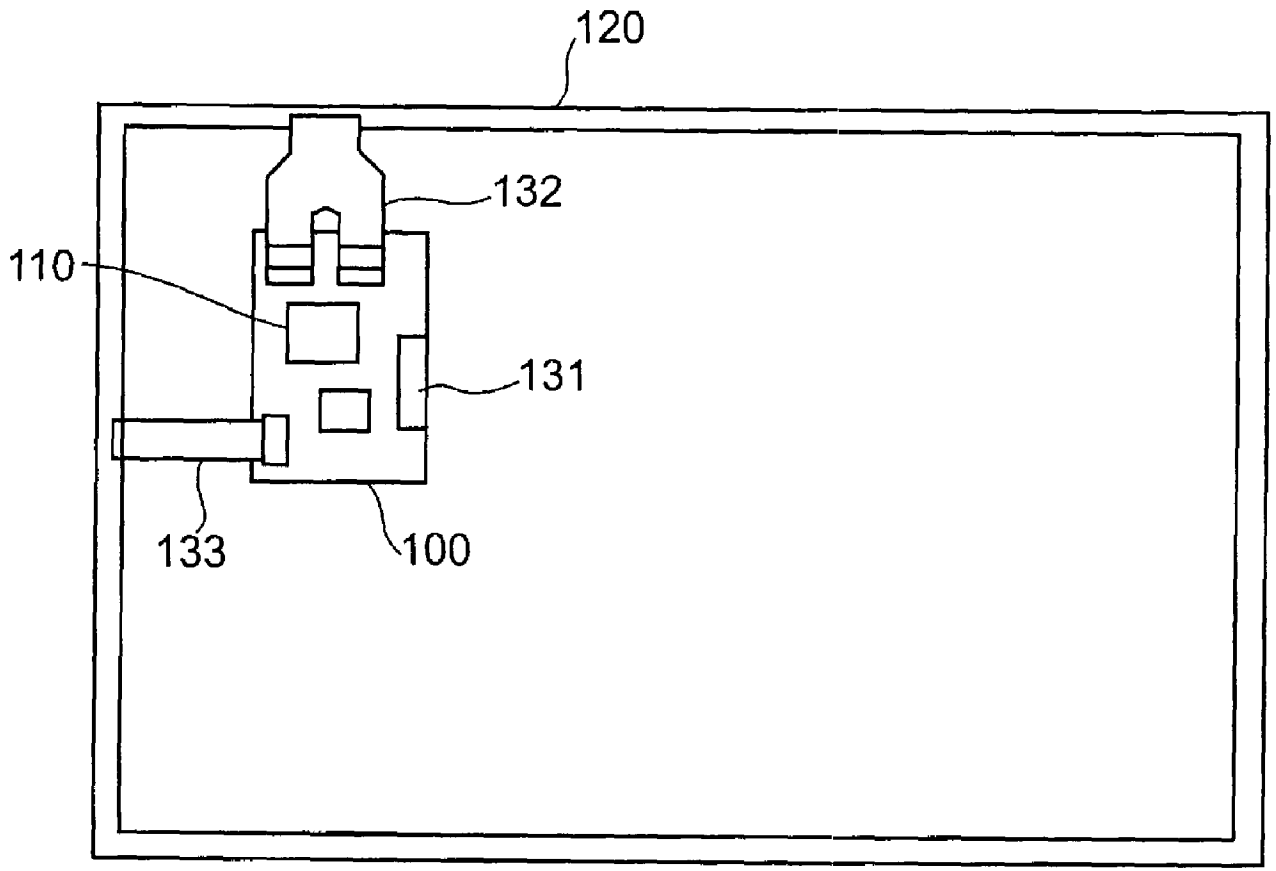
FIG. 21 is a rear view showing a liquid crystal panel of the first embodiment of the present invention.

As shown in FIGS. 1 and 21, the control substrate on which the control circuit 100 is formed is provided with an input connector 131 for signal connection with the outside, a drain driver FPC (Flexible Printed Circuit) 132 for signal connection with the drain driver 121, and a gate driver FPC (Flexible Printed Circuit) 133 for signal connection with the gate driver 122. Through the input connector 131, pass the electric power 111*a* from the outside, as well as the display data 102*a* and control signal 101*a* from the outside. Further, through the drain driver FPC 132, pass the driving data signal 117 and the timing signal 114. And, through the gate driver FPC 133, pass the timing signal 113. Here, FIG. 21 is a view showing the backside of the liquid crystal display panel 120.

The memory control circuit 103 and the display data memory 104 are connected with each other through a data bus 107 of a 16-bit width. Thus, the data bus width of the display data memory is 16 bits, while the display data 102 from the outside is 24-bit data (8 bits×3). Accordingly, the memory control circuit 103 has a function of converting the display data 102 into 16-bit display data.

Figure 2:
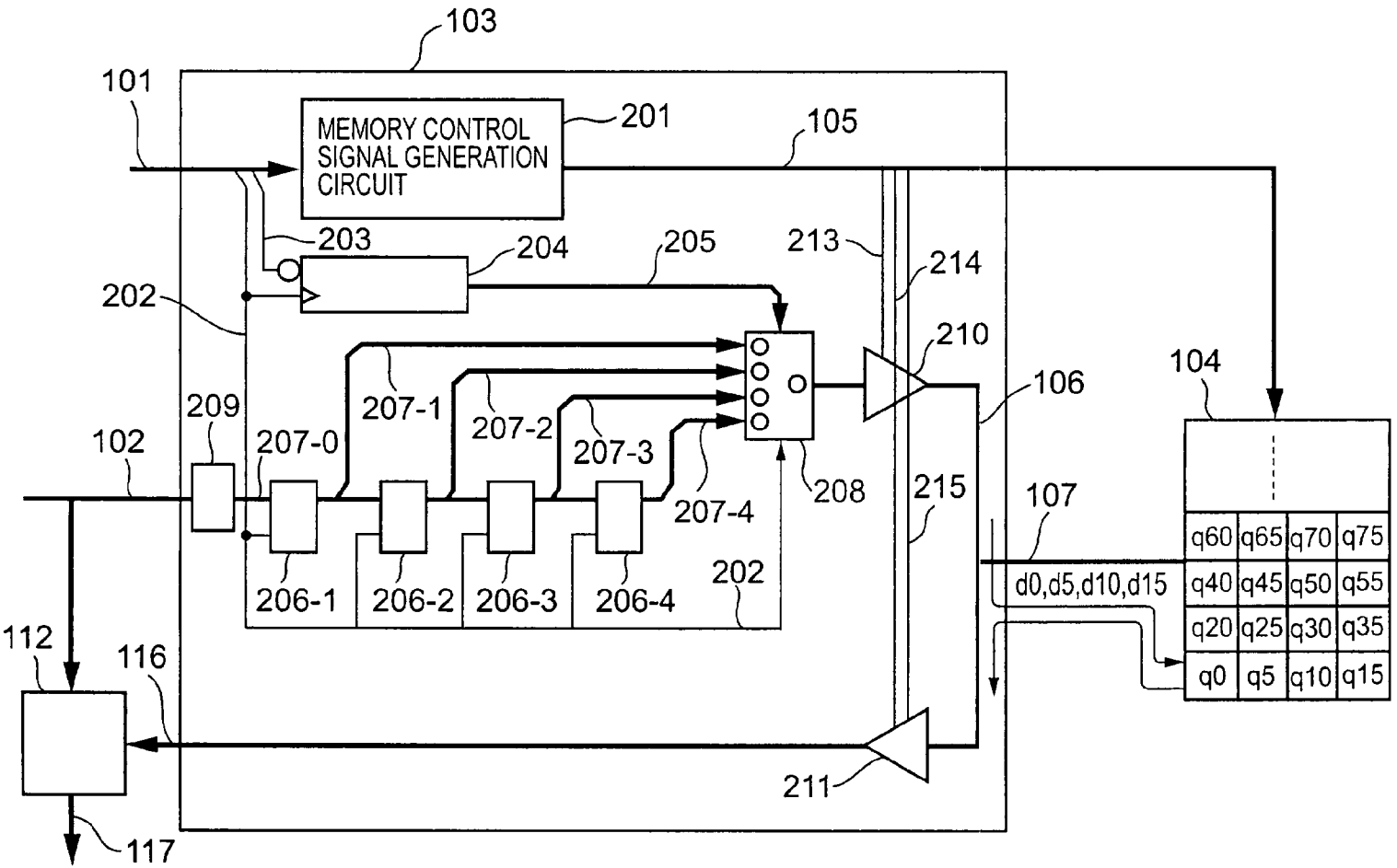
FIG. 2 is a circuit block diagram showing a memory control circuit of the first embodiment of the present invention.
Figure 3:
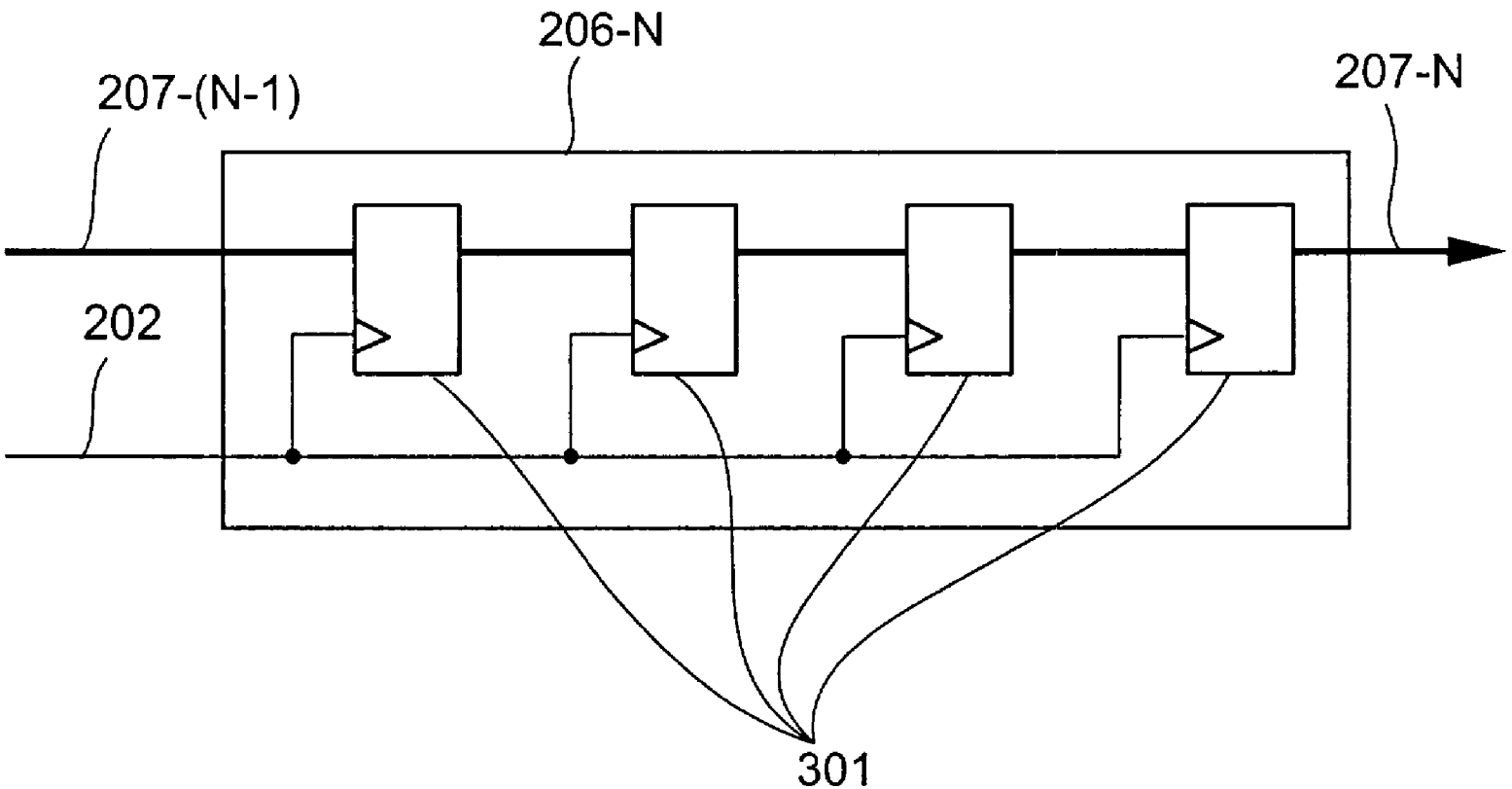
FIG. 3 is a circuit block diagram showing a shift circuit of the first embodiment of the present invention.

As shown in FIG. 2, the memory control circuit 103 comprises: a memory control signal generation circuit 201 for generating a memory control timing signal 105 from the control signal 101; a quaternary counter 204 for counting synchronizing signals 202 included in the control signal 101 to generate a count signal (0, 1, 2, 3, 0, 1, . . . ) 205; a display data compression circuit (a depth-wise compression means) 209 for compressing display data of 24 bits per 1 pixel into 16-bit display data; four shift circuits 206-1–206-4 each for causing phase delay of the compressed display data 207-0 by four clocks, based on the synchronizing signal 202; a selection circuit 208 for selecting output of one shift circuit out of the shift circuits 206-1–206-4, based on a count value indicated by the count signal 205; a write display data buffer 210 for temporally storing output of the selection circuit 208 and for writing the stored output as write display data 106 into the display data memory 104; and a read display data buffer 211 for reading the display data stored in the display data memory 104 and for temporally storing the read data to output the stored data to the data conversion circuit 112. The four shift circuits 206-1–206-4 are connected in series with one another, and, as shown in FIG. 3, each shift circuit has four latching circuits 301, 301, . . . for each holding display data for one clock according to the synchronizing signal.

In the present embodiment, a time-axis-wise compression means is constituted by the quaternary counter 204, four shift circuits 206-1–206-4 and the selection circuit 208, among the components of the memory control circuit 103.

Figure 5:
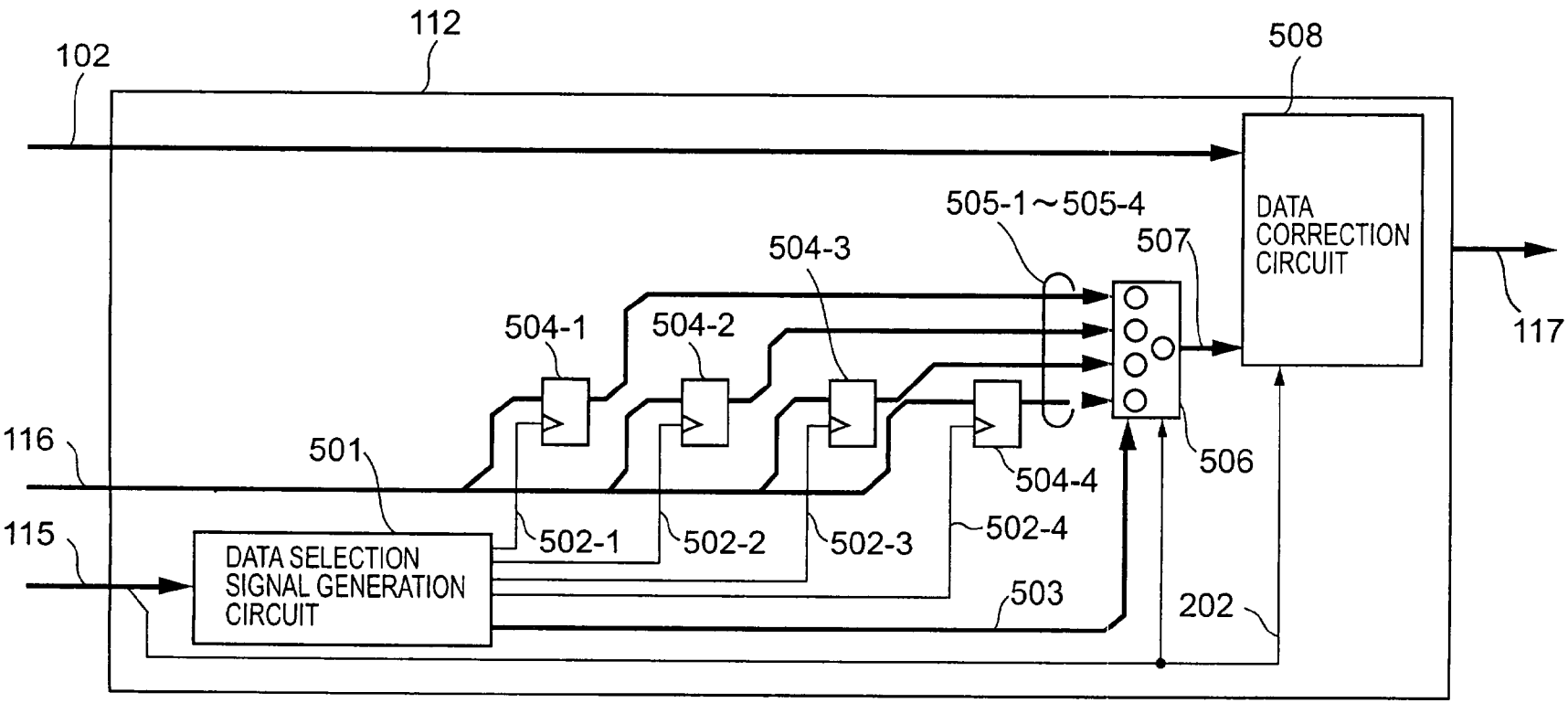
FIG. 5 is a circuit block diagram showing a data conversion circuit of the first embodiment of the present invention.

As shown in FIG. 5, the display data conversion circuit 112 comprises: a data selection signal generation circuit 501 for generating latching signals 502-1–502-4 and a selection signal (0, 1, 2, 3, 4, 0, 1, . . . ) 503, based on the timing signal 115 from the timing signal generation circuit 108 (FIG. 1); four latching circuits 504-1–504-4 for holding read display data 116 from the memory control circuit 103 according to the latching signals 502-1–502-4; a selection circuit 506 for selecting output of one latching circuit out of the latching circuits 504-1–504-4 according to a value indicated by the selection signal 503; and a data correction circuit 508 for generating the driving data signal 117 by comparing the display data for the (n−1)-th frame received from the selection circuit 506 with the display data for the n-th frame received from the outside.

In the present embodiment, the data expansion means is constituted by the data selection signal generating circuit 501, the four latching circuits 504-1–504-4, and the selection circuit 506, among the components of the display data conversion circuit 112.

Next, operation of the above-described liquid crystal display device will be described.

As shown in FIG. 1, display data 102*a* and a control signal 101*a* from the outside are converted in their levels by the level conversion circuit 109 within the TCON circuit 110. The level-converted control signal 101 is sent to the memory control circuit 103 and the timing signal generation circuit 108. And, the level-converted display data 102 is sent to the memory control circuit 103 and the display data conversion circuit 112.

As shown in FIG. 2, the display data 102 is inputted into the data compression circuit (the depth-wise compression means) 209 of the memory control circuit 103. In the data compression circuit 209, the display data 102, whose 24 (=8×3) bits correspond to one pixel, is compressed into 16-bit display data 207-0 to conform with the bus width of the memory data bus 107. Namely, the display data is compressed in the depth direction. In detail, for example, when upper 5 bits of 8-bit data for R (red), upper 6 bits of 8-bit data for G (green) and upper 5 bits of 8-bit data for B (blue) are used, then, 24-bit display data 102 is compressed into 16-bit display data 207-0, i.e., ⅔ of the 24-bit display data 102.

Figure 4:
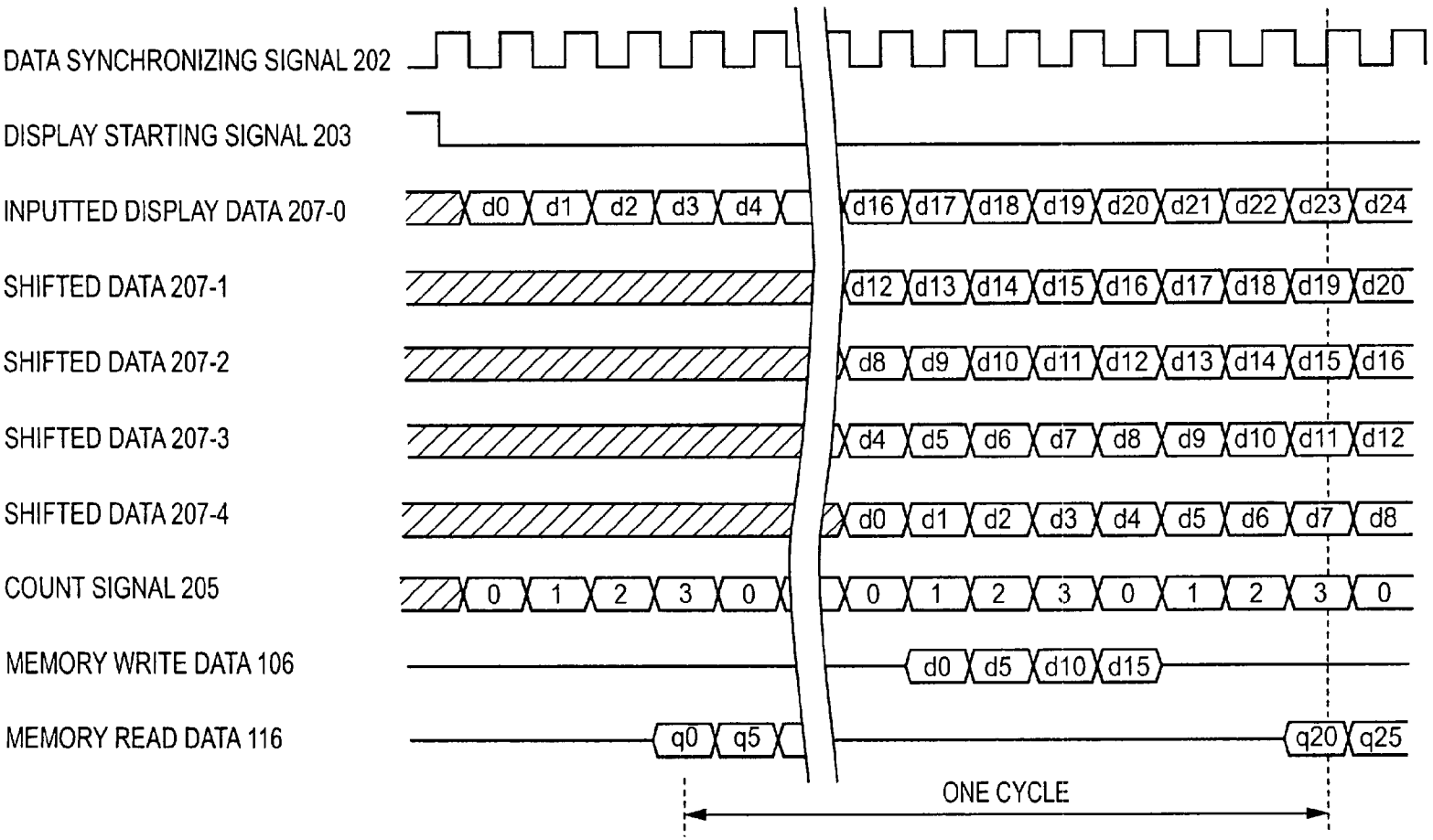
FIG. 4 is a timing chart showing timing of various operations of the memory control circuit of the first embodiment of the present invention.

The memory control signal generation circuit 201 of the memory control circuit 103 generates the memory control timing signal 105 from the control signal 101. Further, when the quaternary counter 204 receives the display timing signal 203 that is included in the control signal 101 and shows start timing for each horizontal period, then, as shown in FIG. 4, the quaternary counter 204 counts synchronizing signals 202 included in the control signal 101, as 0, 1, 2, 3, 0, 1, 2, . . . , and generates the count signal (0, 1, 2, 3, 0, 1, 2, . . . ) 205.

When display data 207-0–207-3 are inputted respectively to the shift circuits 206-1–206-4 of the memory control circuit 103, each shift circuit holds the inputted display data of four clocks, based on the synchronizing signal 202, before outputting the display data. Thus, as shown in FIG. 4, the first shift circuit 206-1 outputs shifted display data 207-1 whose phase is shifted by four clocks from the inputted display data 207-0. The second shift circuit 206-2, to which the shifted display data 207-1 is inputted, delays the phase of the inputted data by four clocks. Finally, the fourth shift circuit 206-4 outputs shifted display data 207-4 whose phase is shifted by 16 clocks from the inputted display data 207-0. Thus, when it is assumed that the inputted display data 207-0 are d0, d1, d2, . . . for respective pixels, and when the shifted display data 207-4 as the output of the fourth shift circuit 206-4 are d0, d1, . . . , then, the shifted display data 207-3 as the output of the third shift circuit 206-3 are shifted by four clocks, giving d4, d5, . . . . The shifted display data 207-2 as the output of the second shift circuit 206-2 are shifted further by four clocks, giving d8, d9, . . . , and the shifted display data 207-1 as the output of the first shift circuit 206-1 are shifted further by four clocks, giving d12, d13, . . . .

The selection circuit 208 of the memory control circuit 103 selects output of one shift circuit out of the shift circuits 206-1–206-4, depending on the count value indicated by the count signal 205. In detail, as shown in FIG. 4, when the count signal 205 indicates 0, then, the selection circuit 208 selects d0, which is the shifted display data 207-4 from the fourth shift circuit 206-4. Next, when the count signal indicates 1, then, the selection circuit 208 selects d5, which is the shifted display data 207-3 from the third shift circuit 206-3. Further, when the count signal indicates 2, then, the selection circuit 208 selects d10, which is the shifted display data 207-2 from the second shift circuit 206-2. Further, when the count signal indicates 3, then, the selection circuit 208 selects d15, which is the shifted display data 207-1 from the first shift circuit 206-1. In other words, the output of the selection circuit 208 is the display data d0, d5, d10, d15 extracted from display data of 20 pixels d0–d19, selecting display data of one pixel out of every display data of 5 (a value of N0 mentioned below) pixels. Thus, the inputted display data 207-0 is compressed to one fifth in the time axis direction.

When the write display buffer 210 accumulates display data (d0, d5, d10, d15) corresponding to 20 pixels from the selection circuit 208, then, the write display data buffer 210 writes the display data, as write display data 106, into the memory 104 according to a write timing signal 213 included in the memory control timing signal 105. At that time, the write display data buffer 210 writes the write display data 106 into an area of the memory 104 corresponding to an address signal 215 included in the memory control timing signal 105. A storage capacity of the display data memory 104 is as large as display data of one frame. However, the capacity for storing one frame of the display data 102 received from the outside is not required. As described above, in the step previous to storing the display data into the memory 104, the display data from the outside is compressed to two thirds in the depth direction, and to one fifth in the time axis direction. Thus, the capacity of two fifteenths (=(⅔)×(⅕)) of the capacity for storing one frame of the display data from the outside 102 is sufficient as the storage capacity of the memory 104.

As shown in FIG. 4, memory access of the memory control circuit 103 is practiced in a cycle of 20 clocks. In the latter part of this cycle, the write display data 106 is written into the memory 104 as described above. On the other hand, in the former part of the cycle, display data of the preceding frame in the memory 104 are read by the read display data buffer 211. The read display data buffer 211 sequentially reads display data q0, q5, q10, q15 corresponding to 20 pixels that precede by one frame, out of an area of the memory 104 corresponding to the address signal 215 included in the memory control timing signal 105, according to the read timing signal 214 included also in the memory control timing signal 105. When the display data corresponding to 20 pixels are accumulated, the read display data buffer 211 sends the data to the data conversion circuit 112. The address signals 215 used for read and write operations in one cycle indicate the same area in the memory 104. Accordingly, when, in the former part of one cycle, display data q0, q5, q10, q15 corresponding to 20 pixels in the top part of an (n−1)-th frame are read from the memory 104, then, in the latter part of this cycle, display data d0, d5, d10, d15 corresponding to 20 pixels in the top part of the n-th frame are written into the same area as the storage area of the display data q0, q5, q10, q15 of the (n−1)-th frame. Further, in the former part of the next cycle, display data q20, q25, q30, q35 corresponding to 20 pixels of the (n−1)-th frame are read from the memory 104, and in the latter part of the cycle, display data d20, d25, d30, d35 corresponding to 20 pixels of the n-th frame are written into the same area as the storage area of the display data q20, q25, q30, q35 of the (n−1)-th frame.

As described above, in the present embodiment, display data 106 corresponding to N (in the present embodiment, N is 20) pixels of an (n−1)-th frame are sequentially read from the display data memory 116, and delivered to the display data conversion circuit 112. And, each time when display data 116 corresponding to N pixels of the (n−1)-th frame are read, display data 106 corresponding to N pixels of the n-th frame are sequentially written into the area of the memory 104 from which the read display data 116 are read. Accordingly, as the storage capacity of the memory, capacity for two frames is not required, and capacity for one frame is sufficient. Storage capacity for one frame is sufficient for alternately reading display data corresponding to N pixels and writing such data into the same area, only in the special case where data to store into the memory are regularly ordered and the data can be stored in the order, and the stored data can be sequentially read in the order of the storing. Of course, it is impossible in the case where random data are stored at random timing and only specific data are read at random timing, as is the case with environment for using a memory of an ordinary computer.

As shown in FIG. 5, the data selection signal generation circuit 501 of the data conversion circuit 112 generates the latching signals 502-1–502-4 and the selection signal (0, 1, 2, 3, 4, 0, 1, . . . ) 503, based on the timing signal 115 from the timing signal generation circuit 108 (FIG. 1). The latching signals 502-1–502-4 are generated with such timing that latched display data 505-1–505-4 each are read display data 116 corresponding to 20 pixels of the preceding frame received from the memory control circuit 103 and can be held for 20 clocks of the synchronizing signal 202. Thus, according to respective latching signals 502-1–502-4, the latching circuits 504-1–504-4 each hold read display data 116 corresponding to 20 pixels of the preceding frame received from the memory control circuit 103, as each latched display data 505-1–505-4 held for 20 clocks of the synchronizing signal 202.

Figure 9:
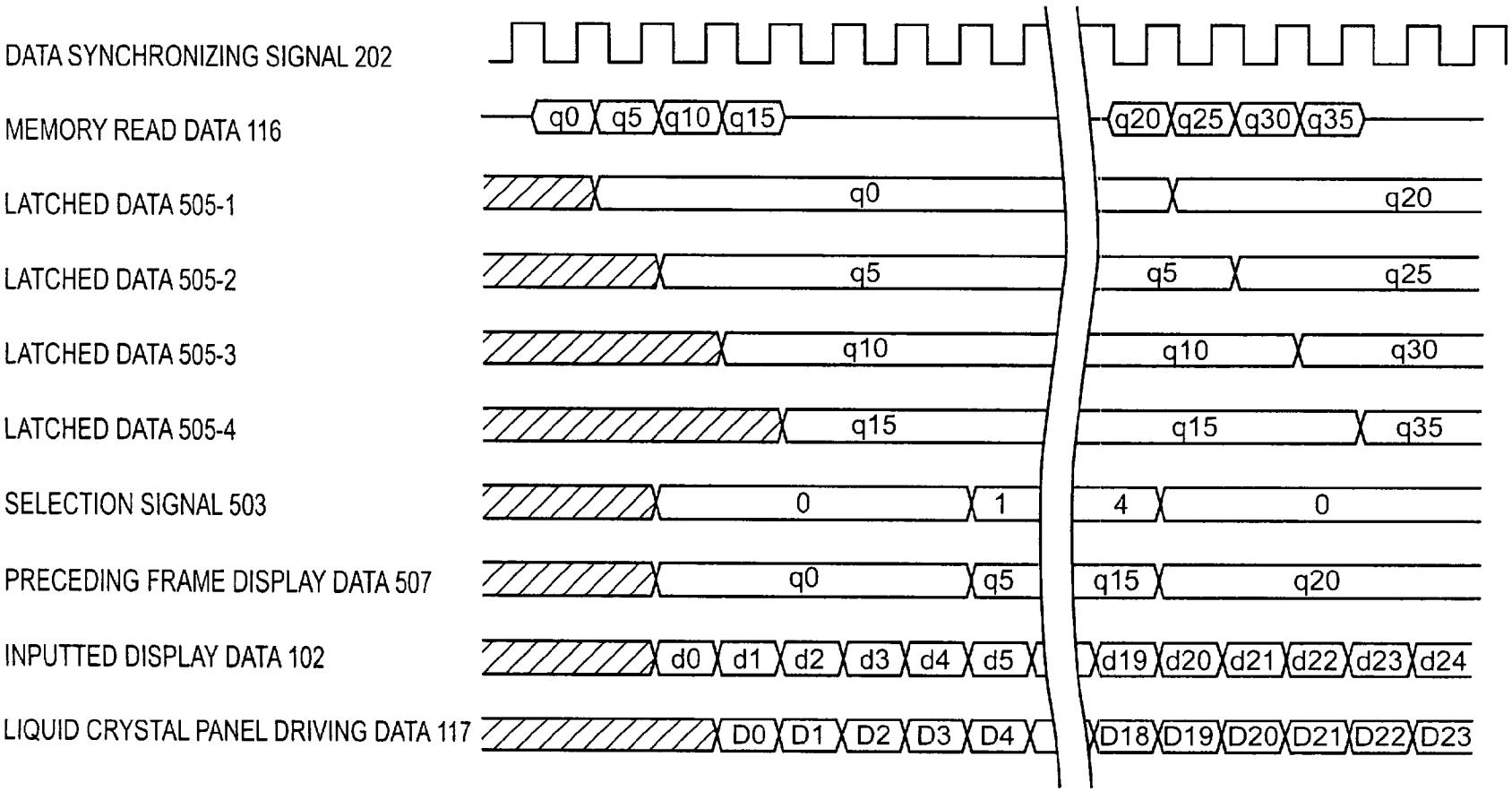
FIG. 9 is a timing chart showing timing of various operations of the data conversion circuit of the first embodiment of the present invention.

As shown in FIG. 9, the data selection signal generation circuit 501 counts up every fifth clocks of the synchronizing signals 202 included in the timing signal 115, and, when the count value becomes 4, then, the data selection signal generation circuit 501 counts from 0 again. This count value (0, 1, 2, 3, 4, 0, 1, . . . ) is outputted as the selection signal 503 to the selection circuit 506. The selection circuit 506 selects output from one of the latching circuits 504-1–504-4, according to the count value indicated by the selection signal 503. Thus, when the read display data 116 inputted into the data conversion circuit 112 are q0, q5, q10, q15, for example, then, the selection circuit 506 first outputs q0 held by the first latching circuit 504-1 into the data correction circuit 508, by the quantity corresponding to 5 clocks. Next, the selection circuit 506 outputs q5 held by the second latching circuit 504-2, by the quantity corresponding to 5 clocks. And, finally, the selection circuit 506 outputs q15 held by the fourth latching circuit 504-4, by the quantity corresponding to 5 clocks. Thus, the data correction circuit 508, to which the display data 507 are inputted from the selection circuit 506, identifies the display data of the 0th pixel through the display data of the 4th pixel as q0, the display data of 5th pixel through the display data of 9th pixel as q5, and the rest as q10 and q15 for each display data of 5 pixels.

The data correction circuit 508 compares thus-inputted display data 507 of the (n−1)-th frame with the display data 102 of the n-th frame, to generate a driving data signal 117, which is delivered to the drain driver 117 (FIG. 1).

Now, a procedure in the data correction circuit 508 for generating the driving data signal 117 will be described referring to flowcharts shown in FIGS. 6 and 7. These flowcharts show processing about the X-th display data counted from the display starting point, d(X) shows the X-th inputted display data 102 counted from the display starting point, q(X) shows the display data 507 of the preceding frame to the X-th frame counted from the display starting point, and D(X) shows display data adapted for a driving data signal 117 for the X-th pixel counted from the display starting point.

Figure 6:
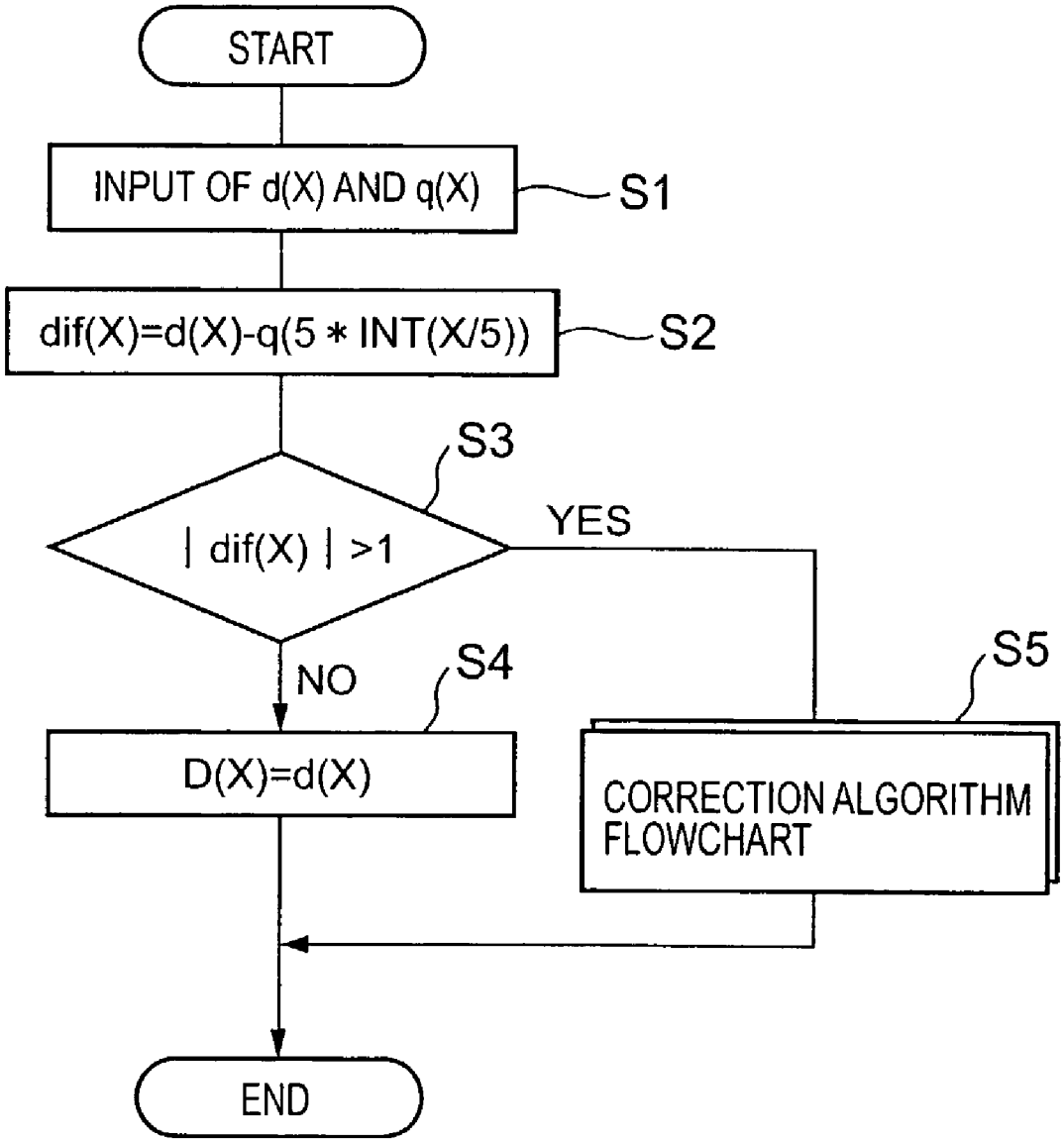
FIG. 6 is a flowchart showing operation of a data correction circuit of the first embodiment of the present invention.

As shown in the flowchart of FIG. 6, when the inputted display data d(X) and the preceding frame display data q(X) are inputted into the data correction circuit 508 (Step 1), then, the data correction circuit 508 calculates a difference dif(X) between them (Step 2). Since the preceding frame display data q(X) changes every fifth pixels, q(X) can be written as q(5×INT(X/5)). Here, INT(X) means a value obtained by rounding X to the nearest integer on the side of 0. Thus, in this Step 2, dif(X)=d(X)−q(5×INT(X/5)) is calculated. Here, the preceding frame display data q(X) have been compressed such that R and B each are 5 bits, and G is 6 bits, while each of R, G and B of the inputted display data d(X) is 8 bits. Thus, the inputted display data d(X) is compressed to have also R and B of 5 bits and G of 6 bits, to calculates the above difference.

Next, it is judged if the absolute value of the difference dif(X) is larger than 1 or not (Step 3). When the absolute value of the difference dif(X) is 1 or less, then it is judged that gradation change towards the display data of the preceding frame hardly exists, or in other words, the image is almost static. And, the inputted display data d(X) is used, as it is, as the display data D(X) adapted for a driving data signal, and the display data D(X) is converted into the driving data signal 117, which is delivered to the drain driver 117 (FIG. 1) (Step 4). On the other hand, when the absolute value of the difference dif(X) is larger than 1, then, it is judged that the image is a dynamic image involving gradation change, and correction algorithm is performed (Step 5). Here, the largeness of the absolute value of the difference dif(X) is judged referring to 1. However, this reference value may be, for example, 2 or 3, depending on the characteristics of the liquid crystal panel.

Figure 7:
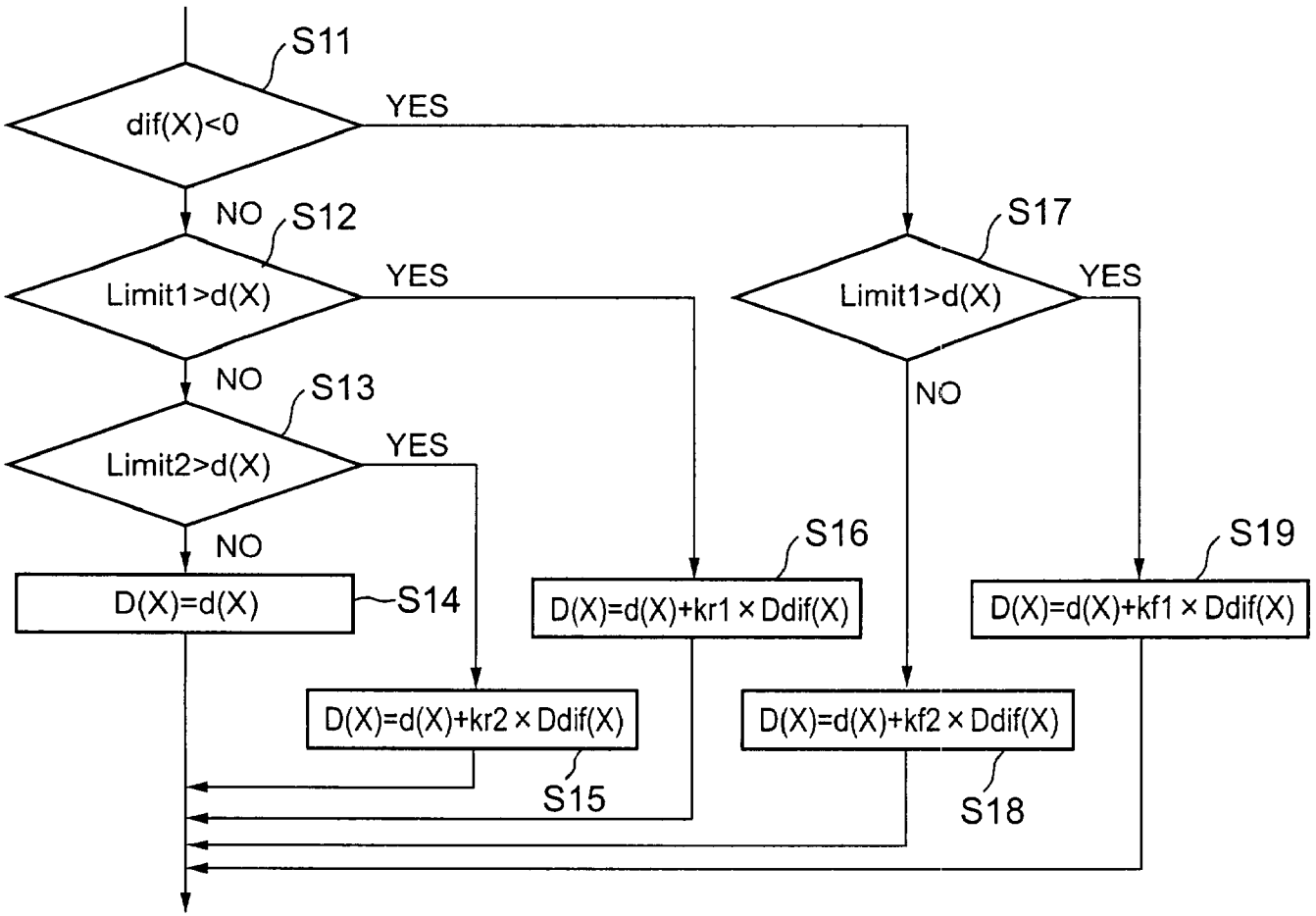
FIG. 7 is a flowchart showing the correction algorithm shown in FIG. 6.

As shown in the flowchart of FIG. 7, first in the correction algorithm, the data correction circuit 508 judges if the difference dif(X) is less than 0, or in other words, if the gradation becomes smaller than the preceding frame, or in still other words, if the brightness falls (Step 11).

In the case (A) where dif(X)>0, or, the brightness rises, then, Steps 12–16 are performed, to determine the driving data signal D(X) in each of the following cases (1)–(3).

(1) d(X)≧limit2 (N0 in Step 13): D(X)=d(X)

$$(2)\text{Limit2} > d(X) \geq \text{Limit1}\,(\text{YES in Step 13}):$$

$$D(X) = d(X) + kr2 \times dif(X)$$

(3) Limit1>d(X)>0 (YES in Step 12): D(X)=d(X)+kr1×dif(X)

Further, in the case (B) where dif(X)<0, or, the brightness falls, then, Steps 17–19 are performed, to determine the driving data signal D(X) in each of the following cases (1) and (2).

(1) d(X)≧Limit1 (N0 in Step 17): D(X)=d(X)+kf2×dif(X)

(2) Limit1>d(X)>0 (YES in Step 17): D(X)=d(X)+kf1×dif(X)

Here, in the above expressions, the limit Limit1, the limit Limit2, the conversion coefficient kr1, the conversion coefficient kr2, the conversion coefficient kf1, and the conversion coefficient kf2 take values such as shown in FIG. 8. Favorably, those values shown in the figure may be changed suitably depending on the characteristics of the liquid crystal panel and the gradation voltage, for example. Further, coefficient-changing switches may be provided to some part of the liquid display device such that those conversion coefficients can be changed suitably. Receiving signals from those coefficient-changing switches, the data correction circuit 508 may change the conversion coefficients according to the received signals.

Figure 10:
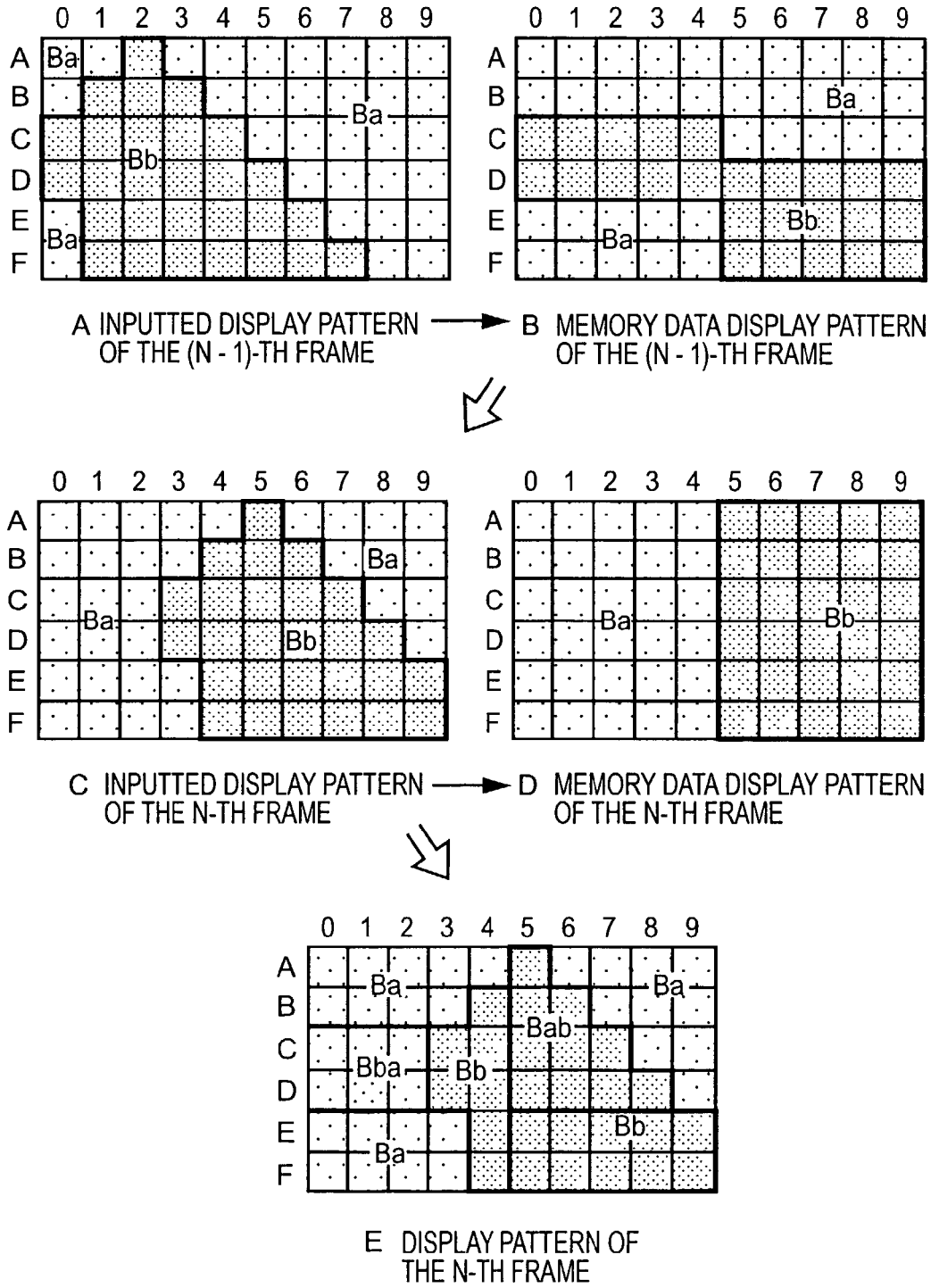
FIG. 10 is an explanatory view showing display patterns in various states in the first embodiment of the present invention.

Next, referring to FIG. 10, it will be described in detail how data correction is performed with respect to a certain display pattern.

For example, in the case where the inputted display data of the (n−1)-th frame display a pattern as shown in FIG. 10A, the memory 104 stores the 0th and 5th columns of the (n−1)-th frame. The 1st–4th columns are treated as the same display data as the 0th column, and the 6th–9th columns are treated as the same display data as the 5th column. Thus, the memory data for the (n−1)-th frame are displayed as shown in FIG. 10B. Further, also in the case where the inputted display data of the n-th frame have a pattern that is shifted by 3 pixels from the pattern of the inputted display data of the (n−1)-th frame as shown in FIG. 10C, the memory 104 stores the 0th and 5th columns of the n-th frame. Since the 1st–4th columns are treated as the same display data as the 0th column, and the 6th–9th columns are treated as the same display data as the 5th column, the memory data for the n-th frame are displayed as shown in FIG. 10D.

Now, it is assumed that the memory data of the (n−1)-th frame (FIG. 10B) and the inputted display data of the n-th frame (FIG. 10C) are used to generate the driving data signal for the n-th frame (FIG. 10E). In this case, both the memory data of the (n−1)-th frame and the inputted display data of the n-th frame are display data Ba in the areas (A, 0)–(A, 4), (A, 6)–(A, 9), (B, 0)–(B, 3), (B, 7)–(B, 9), (C, 8), (C, 9), (D, 9), (E, 0)–(E, 3), and (F, 0)–(F, 3). Accordingly, the inputted display data of the n-frame are not corrected in those areas, and converted as they are into the driving data signal for those areas of the n-th frame. Further, both the memory data of the (n−1)-th frame and the inputted display data of the n-th frame are display data Bb in the areas (B, 4), (C, 3), (C, 4), (D, 3)–(D, 8), (E, 4)–(E, 9), and (F, 4)–(F, 9). Accordingly, the inputted display data of the n-th frame are not corrected in those areas also, and converted as they are into the driving data signal for those areas of the n-th frame.

On the other hand, in the areas (C, 0)–(C, 2) and (D, 0)–(D, 2), the memory data of the (N−1)-th frame are Bb, while the display data of the N-th frame are Ba that is brighter than Bb. Accordingly, the display data for those areas are set to Bba that is brighter than the display data Ba, and this display data Bba is converted into the driving data signal. Further, in the areas (A, 5), (B, 5), (B, 6), and (C, 5)–(C, 7), the memory data of the (N−1)-th frame are Ba, while the display data of the N-th frame are Bb that is darker than Ba. Accordingly, the display data for those areas are set to Bab that is darker than the display data Bb, and this display data Bab is converted into the driving data signal.

Figure 22:
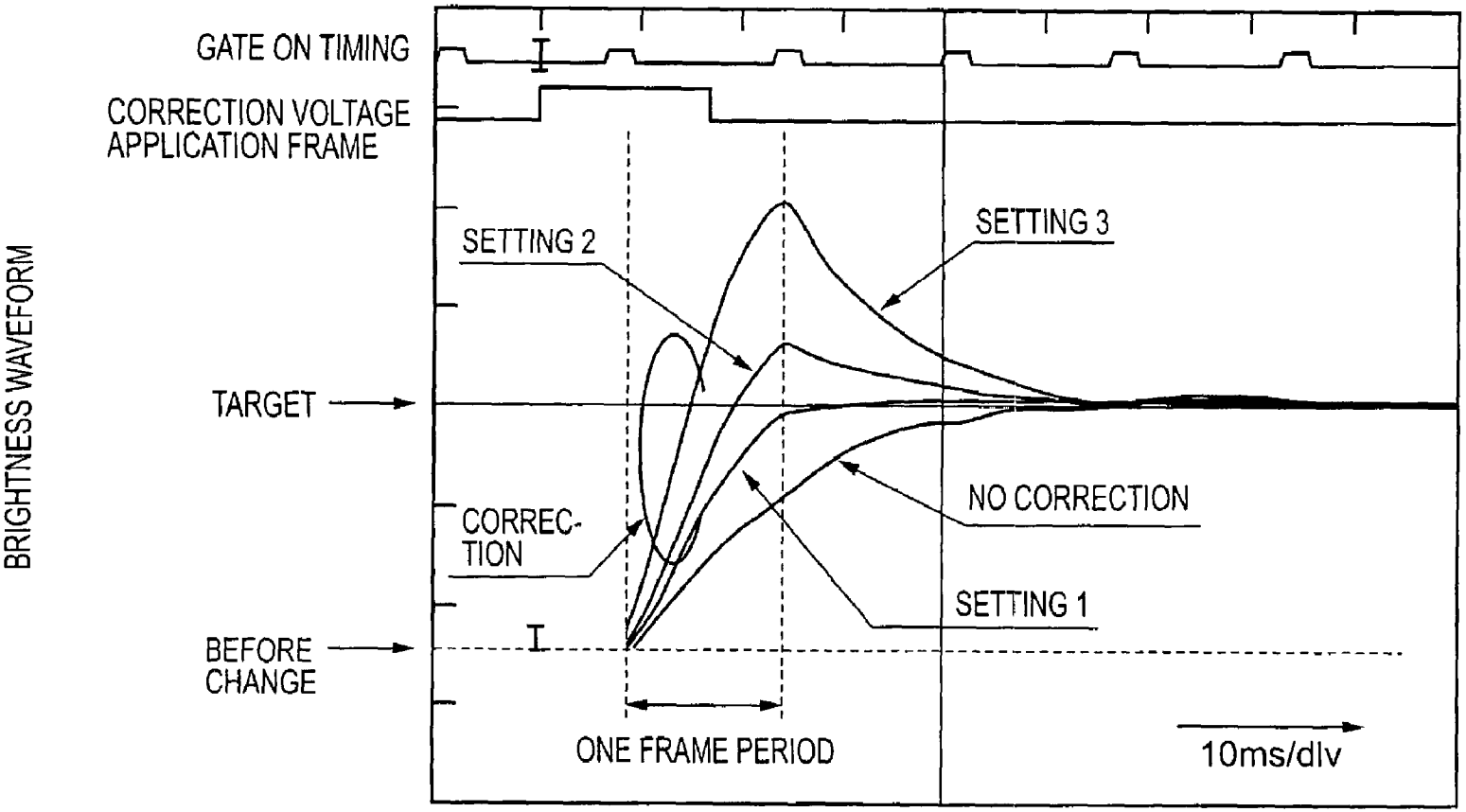
FIG. 22 is an explanatory view showing brightness changes in various cases where display data are or are not corrected in the first embodiment of the present invention.

Namely, in the present embodiment, when the display data in question become brighter than the display data of the preceding frame, the driving data signal is generated so as to realize brighter display than the display data in question. When the display data in question become darker than the display data of the preceding frame, the driving data signal is generated so as to realize darker display than the display data in question. Accordingly, the visual response speed is increased. By way of example, is assumed the case where, as shown in FIG. 22, the brightness of the preceding frame display data is "Before change" shown in the figure, and the brightness of the current display data is "Target" shown in the figure, which is higher than the previous brightness, and the difference between both brightness is larger than the value requiring the above-described correction. Then, by generating the driving data signal that can realize higher brightness than the target brightness, as in the case of "Setting 1", "Setting 2", or "Setting 3" shown in the figure, time required for reaching the "Target" brightness from the "Before change" brightness can be shortened. Here, "Setting 1", "Setting 2", and "Setting 3" show respective states in the cases where the above-mentioned conversion coefficients are changed variously.

As described above, in the present embodiment, the driving data signal is determined by comparing the display data with the preceding frame display data, and accordingly, the visual response speed can be increased. Further, in the present embodiment, the access system to the memory 104 that stores the preceding frame display data is designed such that the storage capacity for one-frame of display data is sufficient as the storage capacity of the memory, as described above. In addition, display data is compressed to two fifteenth, before stored into the memory. Thus, the storage capacity of the memory can be made remarkably smaller. As a result, mounting area of the substrate can be smaller, displaying power can be lowered, and costs can be reduced. Further, since the memory 104 can be made smaller, the TCON circuit 110 including the memory 104 can be made on one chip as shown in FIG. 1, and further miniaturization, more power saving, and higher-speed processing can be realized. Further, in the present embodiment, in the case where the deviation between the display data of the (n−1)-th frame and the display data of the n-th frame is a predetermined value or less, the display data of the n-th frame is not corrected. Accordingly, it is possible to suppress color drift in the state that the image is static or nearly static.

In the present embodiment, the level conversion circuit 109 is included in the TCON circuit 110. However, the level conversion circuit 109 can be placed outside the TCON circuit 110.

Figure 11:
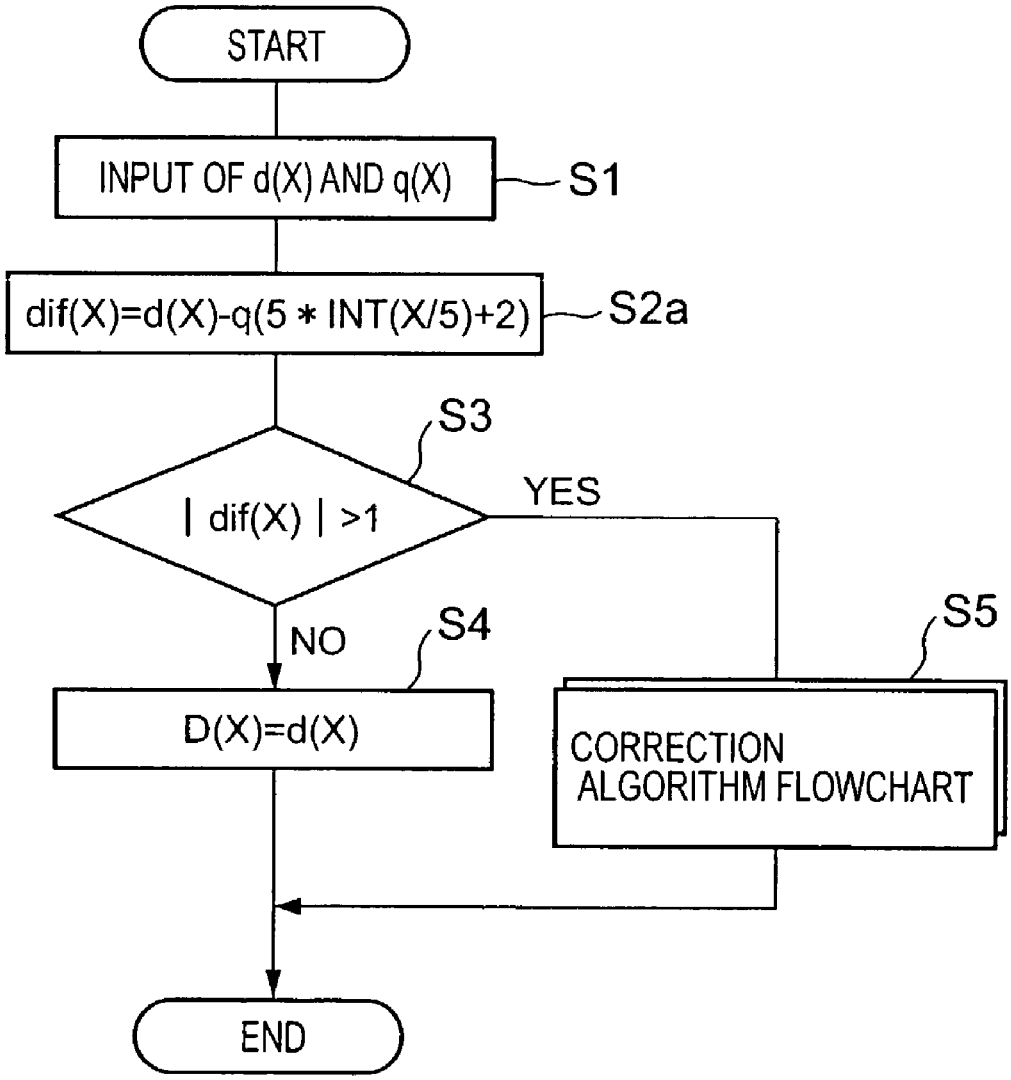
FIG. 11 is a flowchart showing operation of a data correction circuit of a second embodiment according to the present invention.

Next, a liquid crystal display device of a second embodiment according to the present invention will be described referring to FIGS. 11–13.

The present embodiment is fundamentally similar in its configuration and operation to the first embodiment, except that the phases of the write timing and read timing to the memory 104 are shifted.

In the first embodiment, when the inputted display data are q0, q1, q2, q3, q5, q6, . . . , then, on the basis of the data q0 at the display starting point, data of every fifth pixels, q0, q5, q10, . . . are stored into the memory 104. On the other hand, in the present embodiment, on the basis of the data q2 shifted by two pixels from the display starting point, data of every fifth pixels, q2, q7, q12, . . . are stored into the memory 104.

Figure 12:
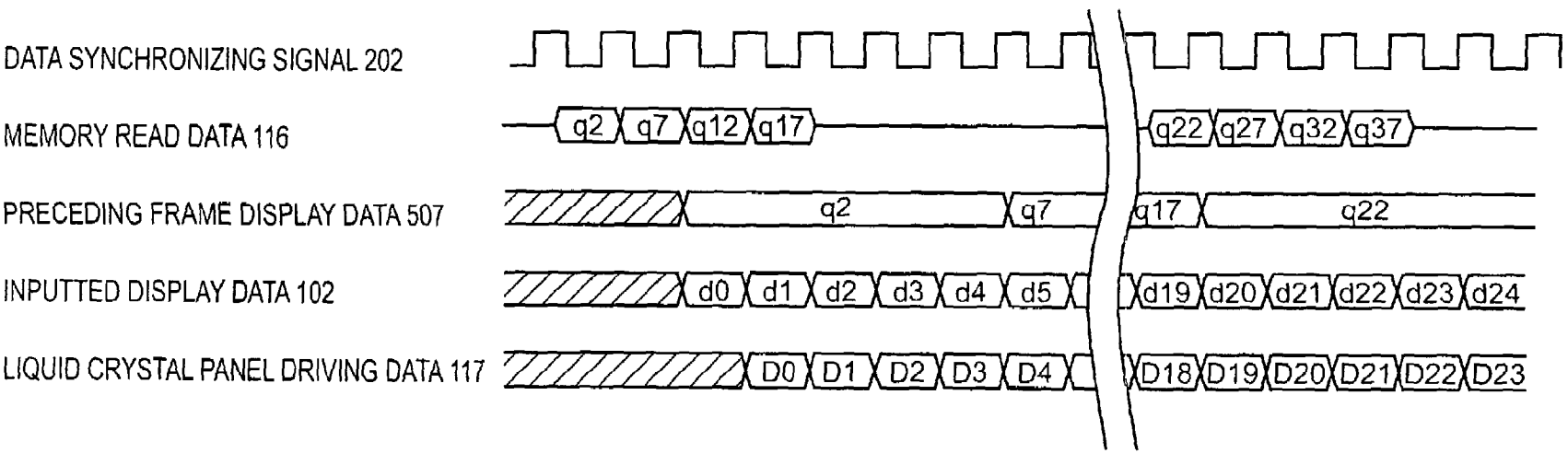
FIG. 12 is a timing chart showing timing of various operations of a data conversion circuit of the second embodiment of the present invention.
Figure 13:
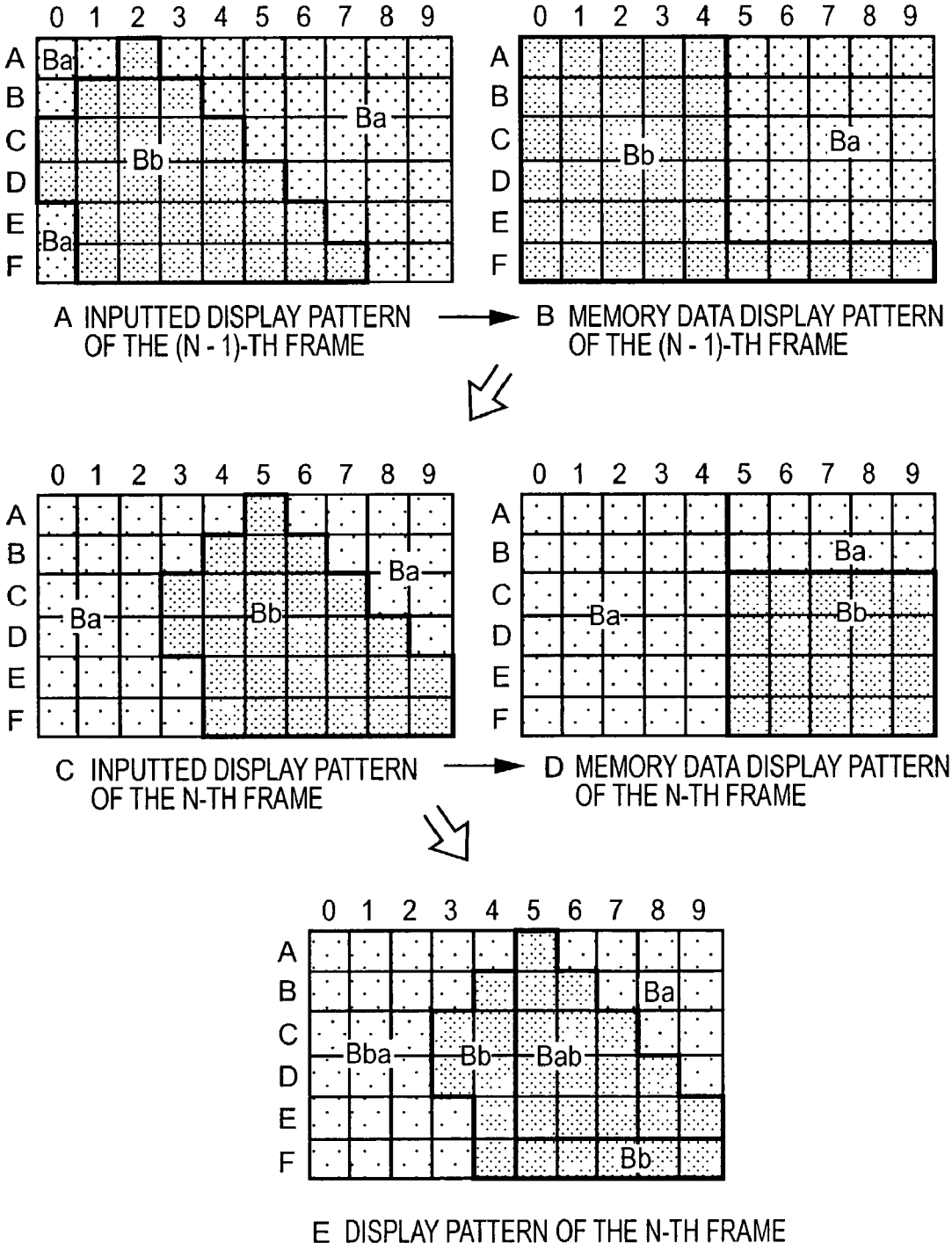
FIG. 13 is an explanatory view showing display patterns in various states in the second embodiment of the present invention.

Further, as shown in FIG. 12, the data of the 0th pixel of the display starting point through the 4th pixel are set to q2, the display data of the 5th pixel through the 9th pixel are set to q7, and the data of the 10th pixel through the 14th pixel are set to q12, before those data are delivered to the data correction circuit 508. In other words, as shown in the flowchart of FIG. 11, when the inputted display data d(X) and the preceding frame display data q(X) are inputted to the data correction circuit 508 (Step 1), then, in the step (Step 2*a*) where the difference dif(X) between both data is calculated, the data q(X) is treated as q(5×INT(X/5)+2).

Thus, in the case where patterns of the inputted display data of the (n−1)-th and n-th frames are respectively as shown in FIGS. 13A and 13C, the memory 104 stores the 2nd and 7th columns of the frame concerned. The 0th–4th columns are treated as the same display data as the 2nd column, and the 5th–9th columns are treated as the same display data as the 7th columns. Thus, the memory data for the (n−1)-th and n-th frames are displayed as FIGS. 13B and 13D, respectively. Of course, in the present embodiment, even if the inputted display pattern is same as in the first embodiment (FIGS. 10A and 10C), display pattern of the memory data, which is to be compared with that same pattern, is different from the first embodiment. Accordingly, the pattern (FIG. 13E) of the driving data signal is also different from the first embodiment.

Here, the time-axis-wise compression in the first and second embodiments will be summarized together. When the display data sequentially inputted from the outside are d(0), d(1), d(2), d(3), . . . , then, these inputted display data are stored as d(0·N0+m), d(1·N0+m), d(2·N0+m), . . . , d(k·N0+m), . . . into the memory 104. Here, N0 is a number obtained by dividing a natural number into the above-mentioned N (=20), i.e., the number of pixels as a unit of reading and writing into the memory 104, and N0 itself is a natural number. In the first and second embodiments, N0 is 5. In other words, multiplying N0 by a natural number, N is obtained. Further, k and m are integers larger than or equal to 0, and N0>m. In the first embodiment, m is 0, and in the second embodiment, m is 2.

Next, a liquid crystal display device of a third embodiment according to the present invention will be described referring to FIGS. 14–16.

In both the above embodiments, out of inputted display data of 5 pixels, display data of one pixel is stored as a representative value into the memory. When the memory display data is used, all the display data of 5 pixels concerned are considered to have the same value as the representative value stored in the memory. On the other hand, in the present embodiment, an average value of inputted display data of 5 pixels is obtained, and stored as a representative value into the memory. When the memory display data is used, all the inputted display data of 5 pixels concerned are considered to have the same value as the average value, i.e., the representative value stored in the memory.

Accordingly, the present invention is fundamentally similar to the first embodiment except that the memory control circuit 103*a* for controlling writing of display data into the memory 104 is different from the first embodiment.

Figure 14:
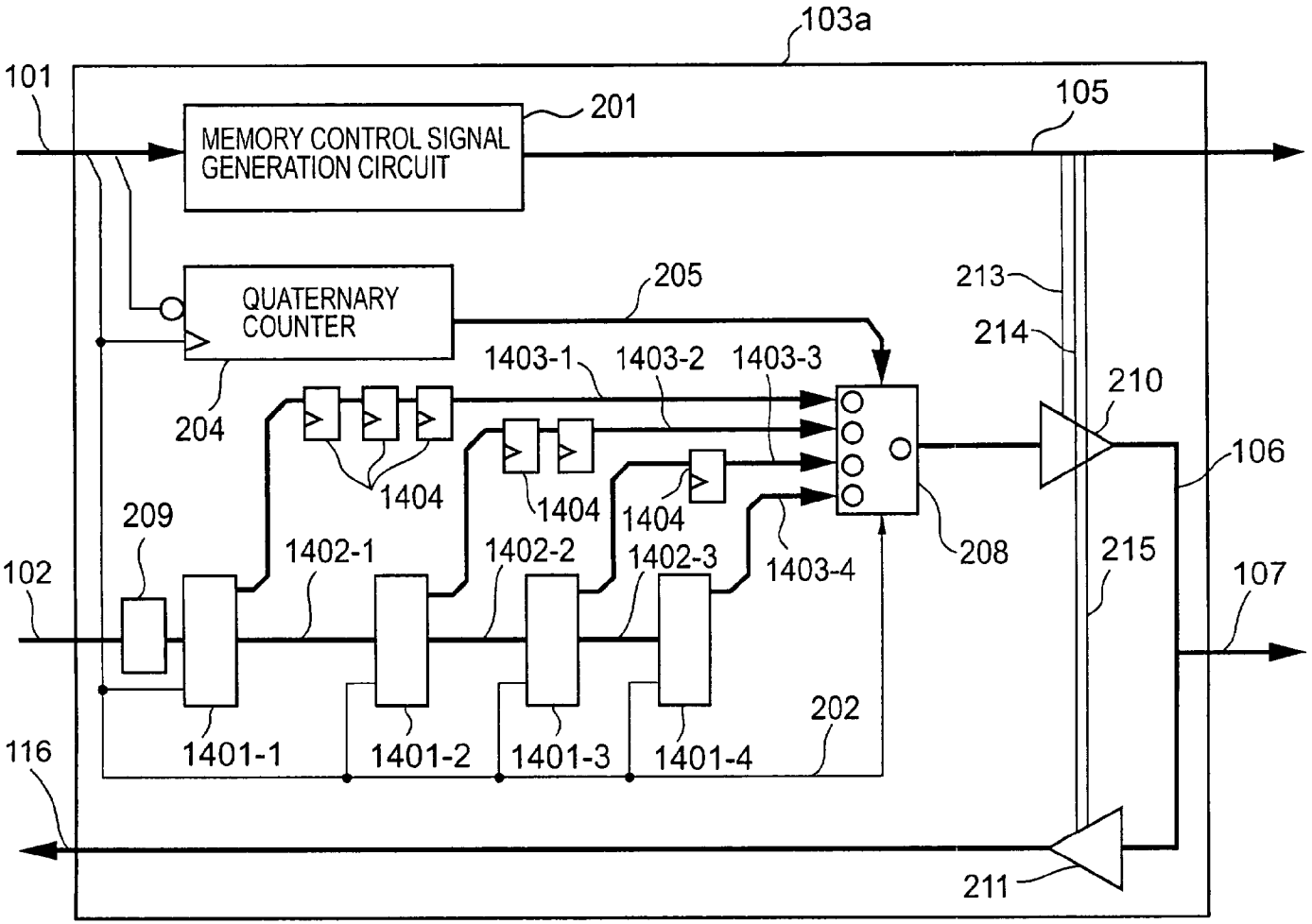
FIG. 14 is a circuit block diagram showing a memory control circuit of a third embodiment according to the present invention.
Figure 15:
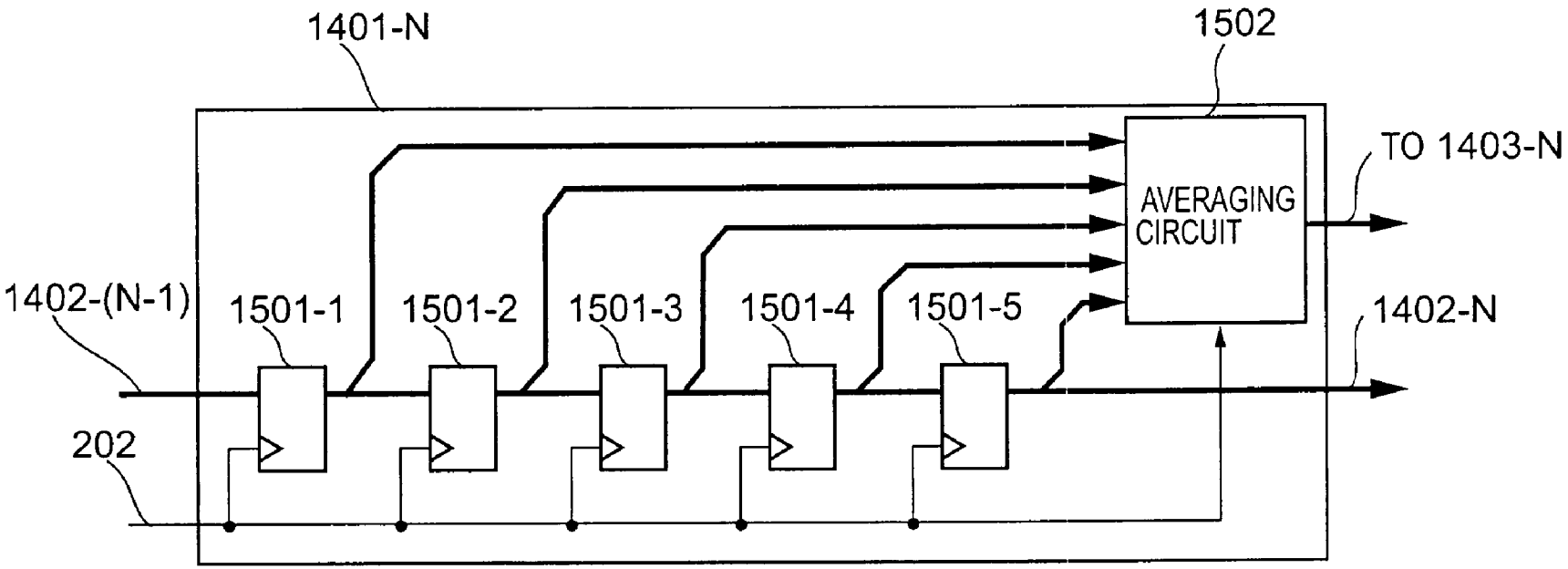
FIG. 15 is a circuit block diagram showing a shift circuit of the third embodiment of the present invention.

As shown in FIG. 14, the memory control circuit 103*a* comprises: four shift/averaging circuits 1401-1–1401-4 connected in series with each other; and latching circuits 1404 connected to the output side of the shift/averaging circuits 1401-1–1401-4. As shown in FIG. 15, each shift/averaging circuit 1401-1–1401-4 comprises: five latching circuits 1501-1–1501-5 connected in series with each other; and an averaging circuit 1502 for obtaining an average value of display data held in the latching circuits 1501-1–1501-5. For example, when a certain shift/averaging circuit 1401-N is inputted with display data d0, d1, d2, d3, d4, and the fifth latching circuit 1501-5 holds d4, then, the fourth latching circuit 1501-4, the third latching circuit 1501-3, the second latching circuit 1501-2, and the first latching circuit 1501-1 hold d3, d2, d1, d0, respectively. The averaging circuit 1502 obtains an average value A0 of the display data d0-d4 held by the latching circuits 1501-1–1501-5, and delivers A0 to the selection circuit 208. Further, the fifth latching circuit 1501-5 delivers d4 to the next shift/averaging circuit 1401-(N+1).

As shown in FIG. 14, 24-bit display data 102 is converted into 16-bit display data by the data compression circuit 209 of the memory control circuit 103*a*, and then, inputted to the first shift/averaging circuit 1401-1. As described above, the first shift/averaging circuit 1401-1 obtains an average value of the inputted display data of 5 pixels, and outputs the average value to the selection circuit 208. Further, the first shift/averaging circuit 1401-1 shifts the display data by 5 pixels to deliver the display data 1402-1 to the second shift/averaging circuit 1401-2. Successively, each of the following shift/averaging circuits 1401-2, -3, -4, operates similarly.

Figure 16:
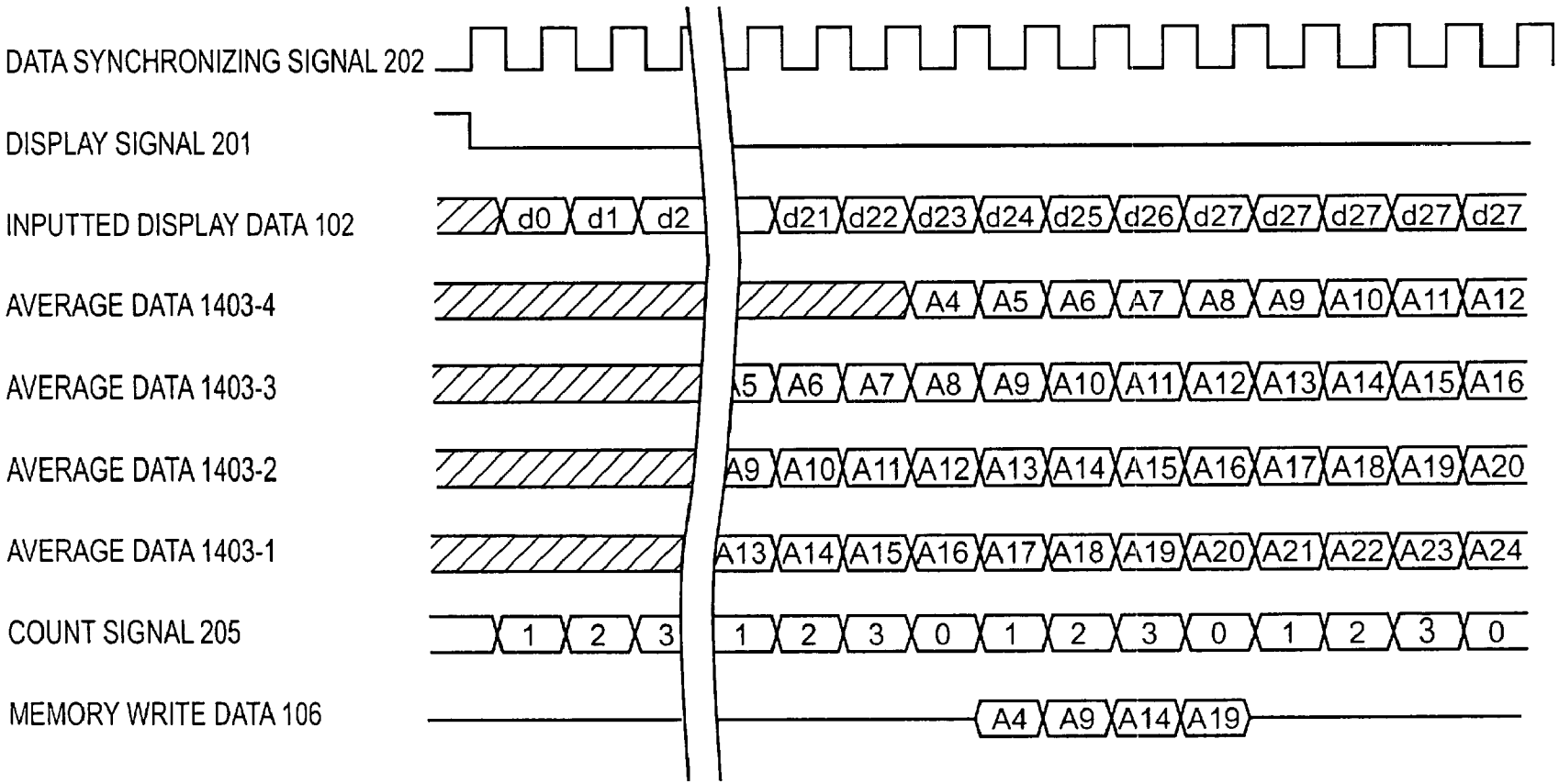
FIG. 16 is a timing chart showing timing of various operations of the memory control circuit of the third embodiment of the present invention.

When it is assumed, as shown in FIG. 16, that the fourth shift/averaging circuit 1401-4 outputs A4 as the average display data 1403-4 to the selection circuit 208, then, the third shift/averaging circuit 1401-3 holds average display data A9 of the display data behind 5 pixels. Since the third shift/averaging circuit 1401-3 is connected to the selection circuit 208 via one latching circuit 1404, A8 is inputted as the average display data 1403-3 to the selection circuit 208. Similarly, the second shift/averaging circuit 1401-2 is outputs A12 as the average display data 1403-2 to the selection circuit 208, via two latching circuits 1404. And, the first shift/averaging circuit 1401-1 outputs A16 as the average display data 1403-1 to the selection circuit 208, via three latching circuits 1404.

Similarly to the first embodiment, the selection circuit 208 selects one input out of the average display data 1403-1–1403-4 inputted from the shift/averaging circuits 1401-1–1401-4, according to a count value indicated by the count signal received from the quaternary counter 204. As shown in FIG. 16, when the count value is 0, the selection circuit 208 selects the average display data 1403-4 from the fourth shift/averaging circuit 1401-4. When it is assumed that the selected average display data 1403-4 is A4, then, the selection circuit 208 next receives the count value 1, and selects A9 as the average display data 1403-3 from the third shift/averaging circuit 1401-3. Successively, when the selection circuit 208 receives the count values 2 and 3 in turn, the selection circuit 208 selects A14 as the average display data 1403-2 and A19 as the average display data 1403-1, respectively.

The data A4, A9, A14, and A19 as the average display data 1403-1–1403-4 selected by the selection circuit 208 are stored temporally in the write display data buffer 210, and then stored into the memory 104, similarly to the first embodiment.

Figure 17:
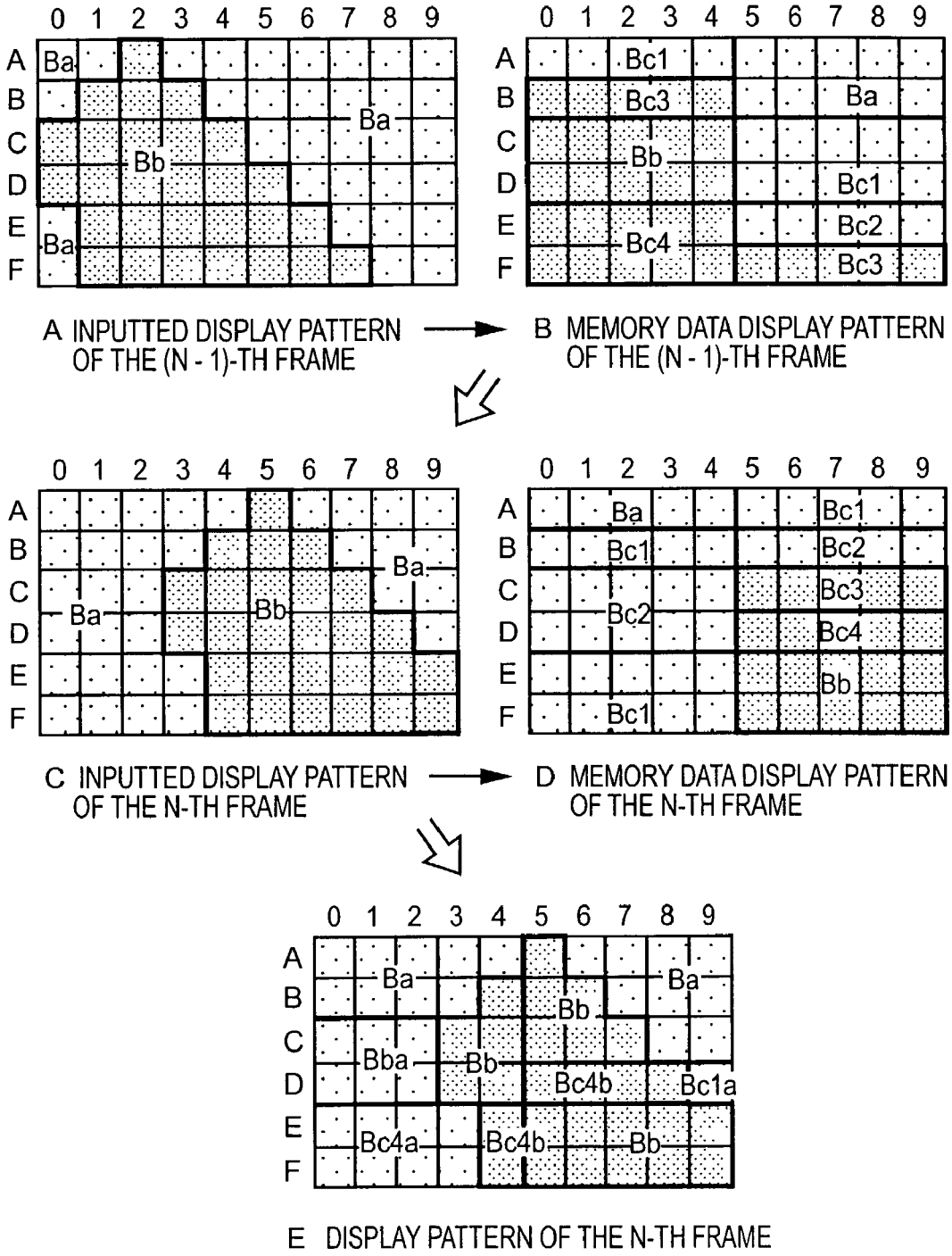
FIG. 17 is an explanatory view showing display patterns in various states in the third embodiment of the present invention.

Now, referring to FIG. 17, will be described the memory display data and driving data signal corresponding to the inputted display data in the present embodiment.

When the patterns of the inputted display data of the (n−1)-th frame and the n-th frame are as shown in FIGS. 17A and 17C, respectively, then, the memory 104 stores the average value of the display data in the 0th through 4th columns and the average value of the display data in the 5th through 9th columns. Thus, these memory display data are displayed as shown in FIGS. 17B and 17D, respectively.

Here, it is assumed, as shown in FIGS. 17A and 17B, that the display data of the 0th through 4th columns of the row A and the 5th through 9th columns of the row D have the average value Bc1, the display data of the 1st through 4th columns of the row B and the 5th through 9th columns of the row F have the average value Bc3, the display data of the 0th through 4th columns of the rows C and D have the average value Bb, the display data of the 0th through 4th columns of the rows E and F have the average value Bc4, and the display data of the 5th through 9th columns of the rows A–C have the average value Ba. Here, the gradations of the average display data change from bright to dark in the order of Ba, Bc1, Bc2, Bc3, Bc4, Bb. It is assumed here that, when the display data of the (n−1)-th frame and the display data of the n-th frame are compared for correction, the display data changed by 3 levels or more in the above-mentioned order is corrected, and the display data changed by 2 levels or less is not corrected. For example, when the display data of the (n−1)-th frame is Ba and the display data of the n-th frame is Bc3, Bc4 or Bb, then, correction is carried out. On the other hand, when the display data of the (n−1)-th frame is Ba and the display data of the n-th frame is Ba, Bc1 or Bc2, correction is not carried out.

Under the above-described assumption, here considered the case where the driving data signal is generated based on the memory display data of the (n−1)-th frame shown in FIG. 17B and the inputted display data of the n-th frame shown in FIG. 17C. Then, out of the inputted display data of the n-th frame, all data of the row A, all data of the row B, the 3rd–9th columns of the row C, the 3rd and 4th columns of the row D, and the 5th–9th columns of the rows E and F are not corrected, and as they are converted into the driving signals as shown in FIG. 17E. On the other hand, the memory data Bb of the 0th–3rd columns of the rows C and D of the (n−1)-frame and the inputted display data Ba of the 0th–3rd columns of the rows C and D of the n-th frame are changed by 3 levels in the above-described order of brightness. Accordingly, the inputted display data Ba of the n-th frame is corrected based on the memory data Bb of the (n−1)-th frame, to obtain a driving data signal Bba as shown in FIG. 17E. Similarly in the other areas, the inputted display data Ba, Bb and Ba are corrected to obtain driving data signals Bc4*a*, Bc4*b* and Bc1*a*.

Next, a liquid crystal display device of a fourth embodiment according to the present invention will be described referring to FIGS. 18–20.

In all the first, second and third embodiments, display data of one pixel out of inputted display data of 5 pixels is stored as a representative value into the memory. In using the memory display data, all the display data of the 5 pixels are considered to have the same value as the representative value corresponding to the one pixel stored in the memory. On the other hand, in the present embodiment, display data of one pixel out of inputted display data of 5 pixels is stored as a representative value into the memory, and in using the memory display data, the representative value corresponding to the one pixel stored in the memory is weighted and then used as the display data of 5 pixels.

Thus, in the present embodiment, the data conversion circuit 112*a* for treating memory display data read from the memory 104 is different from the first embodiment.

Figure 18:
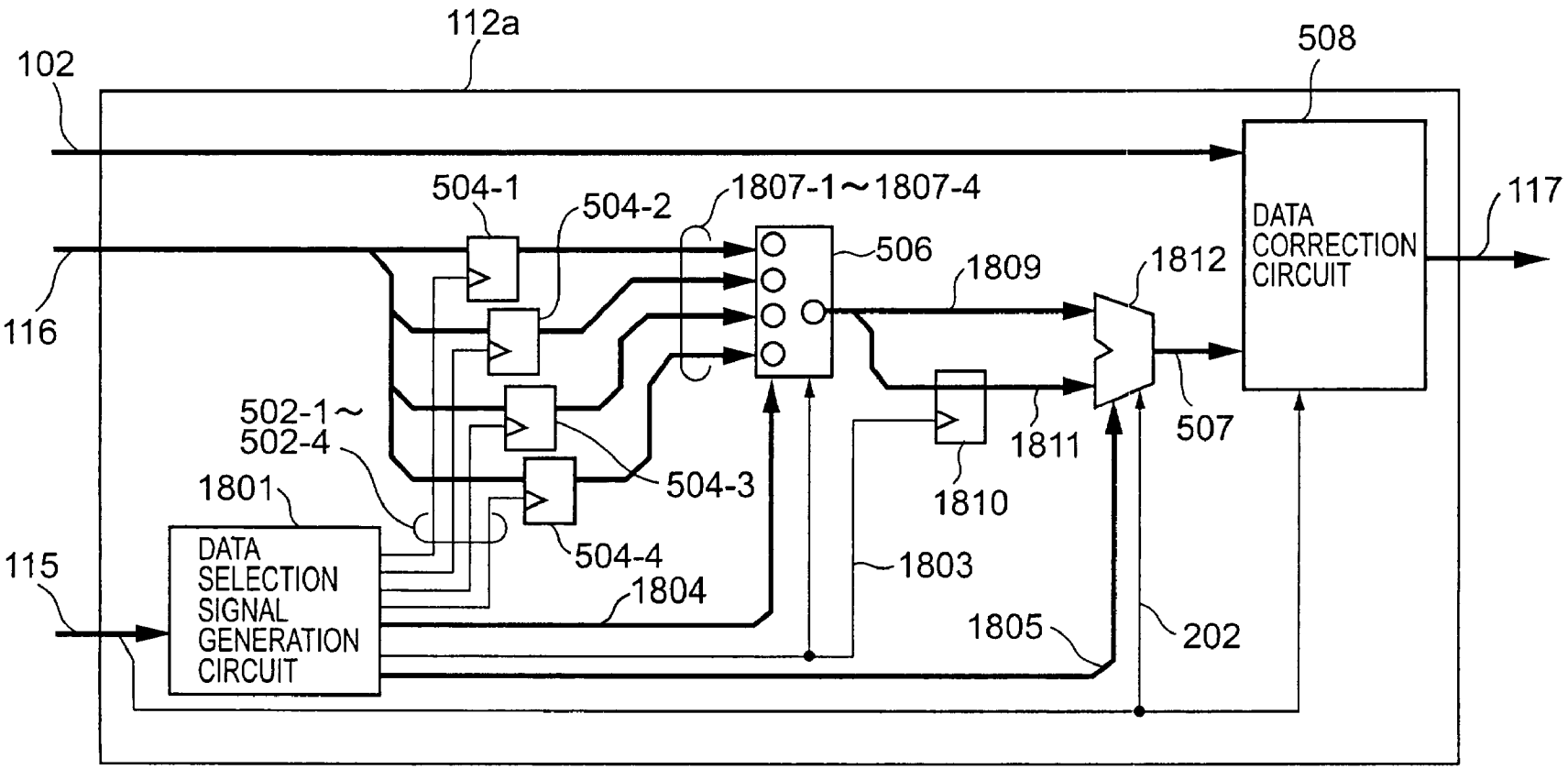
FIG. 18 is a circuit block diagram showing a data conversion circuit of a fourth embodiment according to the present invention.

As shown in FIG. 18, the data conversion circuit 112*a* is provided with a weighting circuit 1812 and a latching circuit 1810 between the selection circuit 506 and data correction circuit 508 of the data conversion circuit 112 (FIG. 5) of the first embodiment. Thus, its operation is similar to the first embodiment until the selection circuit 506.

Figure 19:
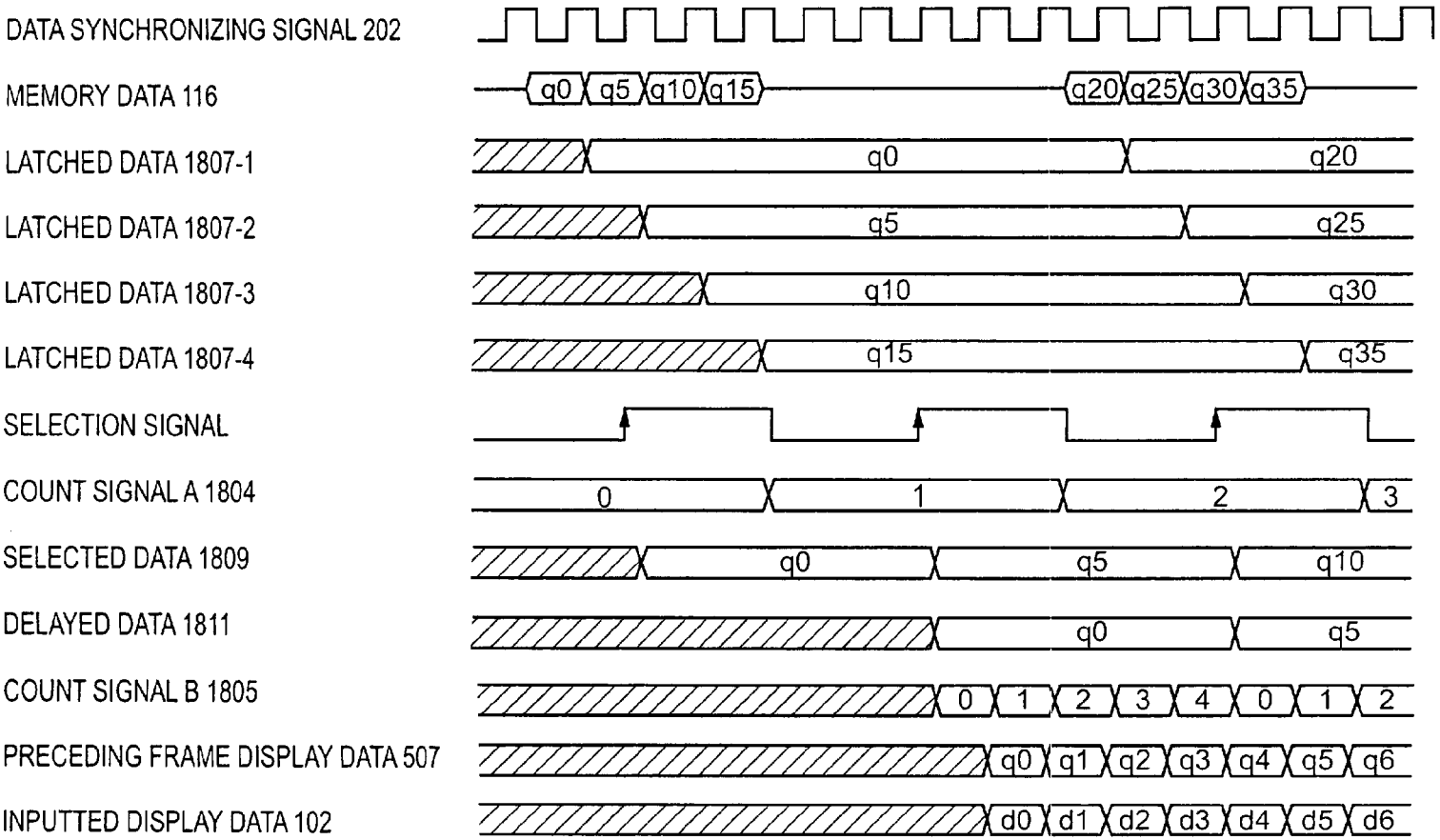
FIG. 19 is a timing chart showing timing of various operations of the data conversion circuit of the fourth embodiment of the present invention.

As shown in FIG. 19, similarly to the first embodiment, when the memory read display data 116 are q0, q5, q10 and q15, then, latched data 1807-1-1807-4 from the latching circuits 504-1–504-4 become q0, q5, q10 and q15 respectively, for 20 clocks corresponding to one cycle. According to a count signal A 1804 (0, 1, 2, 3, 0, 1, . . . ) from the data selection signal generation circuit 1801, the selection circuit 506 sequentially outputs q0, q5, q10 and q15 each for 5 clocks, as selected display data 1809, into the weighting circuit 1812 and the latching circuit 1810. The selected display data 1809 are delayed in phase by 5 clocks in the latching circuit 1810, and outputted as delayed display data 1811 to the weighting circuit 1812. Based on a count signal B 1805 (0, 1, 2, 3, 4, 0, 1, . . . ), from the data selection signal generation circuit, the selected display data 1809, and the delayed display data 1811, the weighting circuit 1812 generates the display data 507 to deliver to the data correction circuit 508. Here, when the selected display data 1809 is the display data q0 of the 0th pixel as the representative value of the display data of the 0th through 4th pixels, then, the delayed display data 1811 becomes the display data q5 of the 5th pixel as the representative value of the display data of the 5th through 9th pixels.

Figure 20:
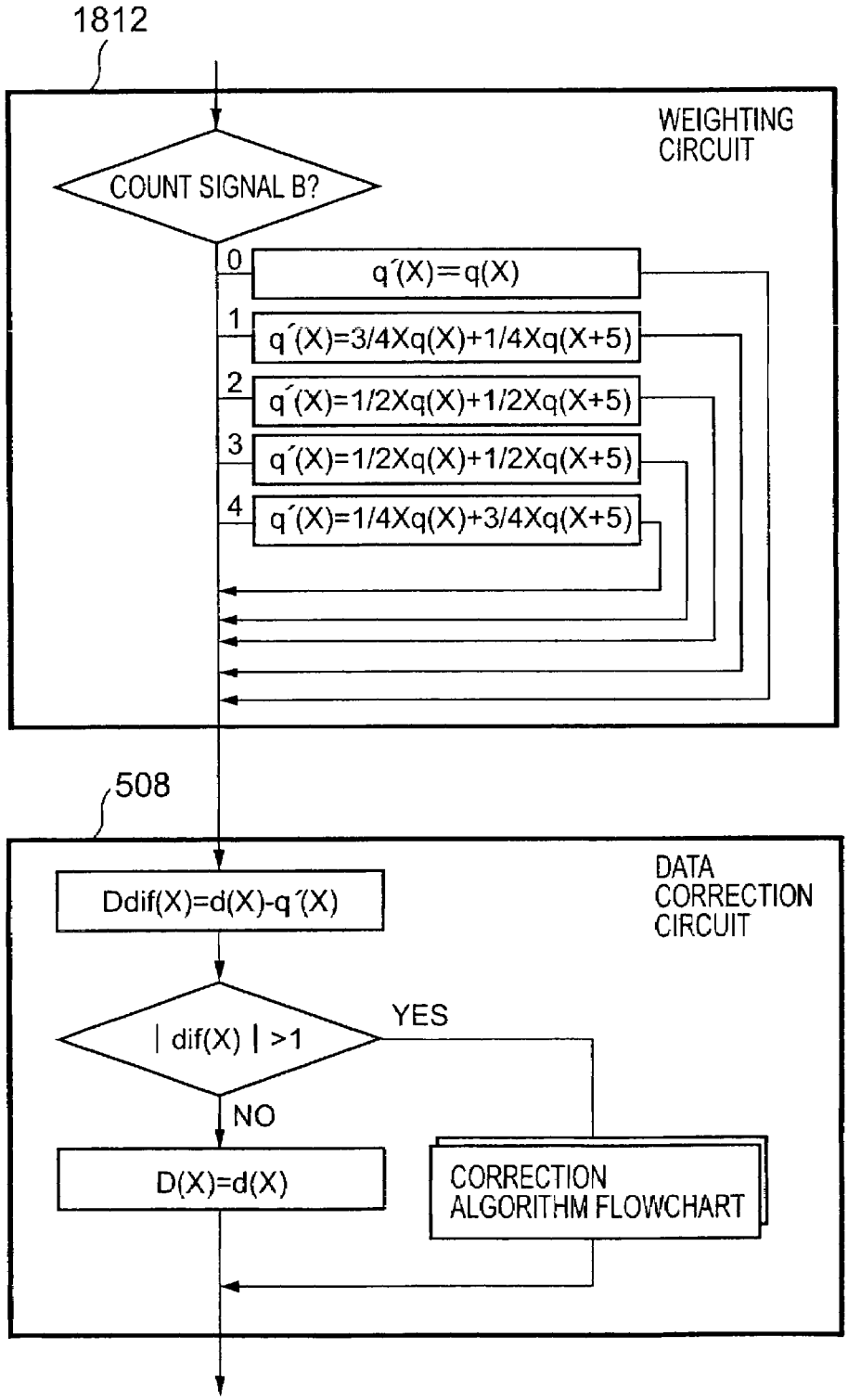
FIG. 20 is a flowchart showing operation of a weighting circuit and a data correction circuit of the fourth embodiment of the present invention.

As shown in FIG. 20, the weighting circuit 1812 judges what is the count value indicated by the count signal B 1805 (0, 1, 2, 3, 4, 0, 1, . . . ) from the data selection signal generation circuit. When the count value is 0, then, the weighting circuit 1812 delivers q(X) as the selected display data 1809, as it is, as the display data q'(X) to the data correction circuit 508. When the count value is 1, then, the weighting circuit 1812 multiplies q(X) as the selected display data 1809 by ¾, multiplies q(X+5) as the delayed display data by ¼, adds both products, and delivers the sum as the display data q'(X) (=(¾)×q(X)+(¼)×q(X+5)) to the data correction circuit 508. Successively, when the count value is 2 or 3, then, the weighting circuit 1812 multiplies q(X) as the selected display data 1809 by ¾, multiplies q(X+5) as the delayed display data by ¾, and delivers the sum of both products, as the display data q'(X) (=(½)×q(X)+(½)×q(X+5)), to the data correction circuit 508. When the count value is 4, then, the weighting circuit 1812 multiplies q(X) as the selected display data 1809 by ¼, multiplies the delayed display data q(X+5) by ¾, and delivers the sum of both products, as the display data q'(X) (=(¼)×q(X)+(¾)×q(X+5)), to the data correction circuit 508. As an example, may be taken a case where q0 and q5 are inputted respectively as the selected display data 1809 and the delayed display data to the weighting circuit 1812. Then, when the count value is 0, the weighting circuit 1812 outputs q0 as the display data of the 0th pixel. When the count value is 1, the weighting circuit 1812 outputs ((¾)×q0+(¼)×q5) as the display data of the first pixel. When the count value is 2 or 3, the weighting circuit 1812 outputs ((½)×q0+(½)×q5) as the display data of the third or 4th pixel. And, when the count value is 4, the weighting circuit 1812 outputs ((¼)×q0+(¾)×q5) as the display data of the 4th pixel.

In the present embodiment, the representative value stored in the memory is used to generate display data of 5 pixels, assuming the memory storage system of the first embodiment. However, also in the case where the memory storage system of the second or third embodiment is employed, display data of 5 pixels may be generated based on the representative value stored in the memory, similarly to the present embodiment.

Further, all the above-described embodiments are concerned with a liquid crystal display device. However, the present invention is not limited to it, and for example, may be applied to a plasma display device, an EL (Electro Luminescence) display device, and the like.

What is claimed is:

1. A display device for displaying according to display data from an outside, comprising:

a display panel;

a driver circuit which receives a driving data signal and drives said display panel according to said driving data signal;

a memory which stores said display data; and a display data conversion circuit which compares display data of an n-th (n is a natural number) frame from outside with display data of an (n−1)-th frame temporally stored in said memory, generates said driving data signal for displaying the n-th frame, based on a comparison result, and produces said driving data signal to said driver circuit, wherein:

said display data conversion circuit corrects said display data of the n-th frame based on said comparison result and generates said driving data signal based on the corrected display data of the n-th frame for displaying the n-th frame, when a difference between said display data of the n-th frame and said display data of the (n−1)-th frame is larger than a predetermined value that is not equal to zero, and said display data conversion circuit generates said driving data signal based on said display data of the n-th frame without correcting for displaying the n-th frame, when a difference between said display data of the n-th frame and said display data of the (n−1)-th frame is less than or equal to said predetermined value.

2. The display device according to claim 1, wherein said predetermined value is to suppress color drift in the state that said display data represents a static image.

3. The display device according to claim 2, wherein:

said display panel comprise a plurality of drain lines, a plurality of gate lines to intersect those drain lines; and said driver circuit comprises a drain driver circuit applies voltage on said plurality of drain lines of said display panel, corresponding to said driving data signal;

and a gate driver circuit applies voltage on said plurality of gate lines of said display panel.

4. A display device, comprising:

a display panel;

a driver circuit arranged to drive said display panel according to a driving data signal;

a memory arranged to store display data;

a display data conversion circuit arranged to compare display data of an n-th (n is a natural number) frame from an external source with display data of an (n−1)-th frame temporally stored in said memory, generate said driving data signal for displaying the n-th frame, based on a comparison result, and produce said driving data signal to said driver circuit for driving said display panel; and a memory control circuit arranged to read display data of N pixels (N is a natural number greater than 1) of the (n−1)-th frame from said memory for delivery to said display data conversion circuit, and correspondingly to reading said display data of N pixels of the (n−1)-th frame, to write display data of N pixels of the n-th frame into said memory, wherein said memory control circuit comprises data compression means for performing data compression of said display data that are written into said memory, and wherein said display data conversion circuit comprises data expansion means for performing data expansion of said display data that have been compressed and stored in said memory.

5. The display device according to claim 4, wherein said memory, said display data conversion circuit and said memory control circuit are formed on a single circuit chip.

6. The display device according to claim 5, wherein:

said display panel comprise a plurality of drain lines, a plurality of gate lines to intersect those drain lines; and said driver circuit comprises a drain driver circuit applies voltage on said plurality of drain lines of said display panel, corresponding to said driving data signal;

and a gate driver circuit applies voltage on said plurality of gate lines of said display panel.

7. A display device, comprising:

a display unit;

a driver circuit for receiving a driving data signal and driving said display unit according to said driving data signal;

a memory for storing display data;

a display data conversion circuit which compares display data of an n-th (n is a natural number) frame from an outside with display data of an (n−1)-th frame temporally stored in said memory, generates said driving data signal for displaying the n-th frame, based on a comparison result, and outputs said driving data signal to said driver circuit; and a memory control circuit which reads display data of N (N is a natural number greater than 1) pixels of the (n−1)-th frame from said memory to deliver read display data to said display data conversion circuit, and, correspondingly to reading of said display data of N pixels of the (n−1)-th frame, writes display data of N pixels of said n-th frame into an area of said memory from which said display data of N pixels of the (n−1)-th frame having been read.

8. The display device according to claim 7, further comprising:

a data compression circuit for compressing said display data that are written into said memory.

9. The display device according to claim 8, wherein:

said data compression circuit has a depth-wise compression circuit for compressing data quantity corresponding to one pixel of said display data.

10. The display device according to claim 8, wherein:

said data compression circuit has a time-axis-wise compression circuit for compressing data quantity of said display data in a direction of a time axis; and a data expansion circuit is provided for expanding said display data that have been compressed by said time-axis-wise compression circuit and stored in said memory.

11. The display device according to claim 10, wherein:

with respect to display data d(0), d(1), d(2), d(3), . . . inputted sequentially from the outside, said time-axis-wise compression circuit stores d(0·N0+m), d(1·N0+m), d(2·N0+m), . . . , d(k·N0+m) as the display data stored into said memory, taking each of d(0·N0+m), d(1·N0+m), d(2·N0+m), . . . , d(k·N0+m) as a representative value of display data of N0 pixels, wherein each of k and m is an integer larger than or equal to 0, N0 is a natural number obtained by dividing the number N of said N pixels by a natural number, and N0>m.

12. The display device according to claim 10, wherein:

said time-axis-wise compression circuit stores an average value of display data of N0 pixels into said memory, taking said average value as a representative value of said display data of N0 pixels, where N0 is a natural number obtained by dividing the number N of said N pixels by a natural number.

13. The display device according to claim 11, wherein:

said data expansion circuit utilizes said representative value (which is obtained as compression by said time-axis-wise compression circuit) of said display data of N0 pixels, for display data of each pixel as a component of said display data of N0 pixels.

14. The display device according to claim 12, wherein:

said data expansion circuit utilizes said representative value (which is obtained as compression by said time-axis-wise compression circuit) of said display data of N0 pixels, for display data of each pixel as a component of said display data of N0 pixels.

15. The display device according to claim 11, wherein said data expansion circuit utilizes:

the representative value (which is obtained as compression by said time-axis-wise compression circuit) of said display data of N0 pixels (referred to as a group of expansion object display data), a representative value of display data of N0 pixels next to said group of expansion object display data in an input order of display data from the outside, and weighting coefficients applied respectively to the representative values, wherein said weighting coefficients are determined in advance for display data of each pixel of N0 pixels constituting said group of expansion object display data, to obtain display data of each pixel of the N0 pixels constituting said group of expansion object display data.

16. The display device according to claim 12, wherein said data expansion circuit utilizes:

the representative value (which is obtained as compression by said time-axis-wise compression circuit) of said display data of N0 pixels (referred to as a group of expansion object display data), a representative value of display data of N0 pixels next to said group of expansion object display data in an input order of display data from the outside, and weighting coefficients applied respectively to the representative values, wherein said weighting coefficients are determined in advance for display data of each pixel of N0 pixels constituting said group of expansion object display data, to obtain display data of each pixel of the N0 pixels constituting said group of expansion object display data.

17. The display device according to claim 7, wherein said display data conversion circuit obtains display data D(X) adapted for said driving data signal, by a following expression:

$$D(X)=d(X)+k(d,\ q)\times(d(X)-q(X))$$

where d(X) shows said display data of the n-th frame from the outside, q(X) shows display data corresponding to said d(X) out of said display data of the (n−1)-th frame temporally stored in said memory, D(X) shows the display data that correspond to said d(X) and are adapted for said driving data signal, and k(d, q) is a real number that is determined based on d(X) and q(X) and larger than or equal to 0.

18. The display device according to claim 17, further comprising:

a coefficient conversion circuit for changing a value of said k(d, q).

19. The display device according to claim 7, wherein:

said display data conversion circuit which converts said display data of the n-th frame, as they are, into said driving data signal for displaying the n-th frame, without correcting said display data of the n-th frame based on said display data of the (n−1)-th frame, when a deviation between said display data of the n-th frame from the outside and said display data of the (n−1)-th frame temporally stored in said memory is less than or equal to a predetermined value.

20. The display device according to claim 7, wherein:

said memory, said display data conversion circuit and said memory control circuit are formed on a single circuit chip.

* * * * *